US010639657B2

(12) United States Patent
Fontaine et al.

(10) Patent No.: US 10,639,657 B2
(45) **Date of Patent: *May 5, 2020**

(54) MIX ON DEMAND SMART BACKPACK SPRAYER

(71) Applicant: Chapin Manufacturing, Inc., Batavia, NY (US)

(72) Inventors: James R. Fontaine, Marilla, NY (US); David Dubiel, N. Chili, NY (US); Morgan Allis, Batavia, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/156,284

(22) Filed: Oct. 10, 2018

(65) Prior Publication Data

US 2019/0105674 A1 Apr. 11, 2019

Related U.S. Application Data

(63) Continuation-in-part of application No. 15/725,937, filed on Oct. 5, 2017, now Pat. No. 10,464,087.

(51) Int. Cl.
*B05B 7/12* (2006.01)
*B05B 7/24* (2006.01)
(Continued)

(52) U.S. Cl.
CPC ..... *B05B 7/12* (2013.01); *B05B 7/0408* (2013.01); *B05B 7/2464* (2013.01);
(Continued)

(58) Field of Classification Search
CPC ..... B05B 7/0408; B05B 7/12; B05B 7/1209; B05B 7/1218; B05B 7/1459; B05B 7/2402; B05B 7/2464; B05B 7/2475; B05B 7/26; B05B 7/28; B05B 7/30; B05B 12/002; A01M 7/0017; A01M 7/0021;
(Continued)

(56) References Cited

U.S. PATENT DOCUMENTS 2,788,245 A * 4/1957 Gilmour ..... B05B 7/12 239/73
2,991,939 A 7/1961 Packard
(Continued)

*Primary Examiner* — Darren W Gorman
(74) *Attorney, Agent, or Firm* — Woods Oviatt Gilman LLP; Katherine H. McGuire, Esq.

(57) ABSTRACT

A backpack sprayer system includes a mounting bracket having a battery receiving fixture to receive a battery. A first tank is mounted to the mounting bracket and holds a diluent. A second tank is mounted to the mounting bracket and holds a liquid concentrate. A mixing manifold is mounted to the mounting bracket and has a first inlet fitting to receive a fixed amount of diluent and a second inlet to receive an adjustable amount of liquid concentrate. The fixed amount of diluent and adjustable amount of concentrate are combined to form a mixed solution and the mixing manifold includes a mixed solution outlet. A positive displacement pump is mounted to the mounting bracket and a suction port coupled to the mixed solution outlet and a pressure port fluidly coupled with a spray device. A control unit is mounted on the mounting bracket and receives power from the battery.

11 Claims, 17 Drawing Sheets

(51) Int. Cl.
*B05B 7/04* (2006.01)
*B05B 12/00* (2018.01)
*B05B 7/30* (2006.01)

(52) U.S. Cl.
CPC ..... *B05B 7/2472* (2013.01); *B05B 7/2475* (2013.01); *B05B 7/2486* (2013.01); *B05B 7/30* (2013.01); *B05B 12/002* (2013.01); *B05B 12/004* (2013.01)

(58) Field of Classification Search
CPC ..... A01M 7/0032; A01M 7/0035; A01M 7/0046; A01M 7/0089
See application file for complete search history.

(56) References Cited

U.S. PATENT DOCUMENTS 3,921,907 A 11/1975 Anderson
4,702,419 A * 10/1987 Luchsinger ..... B05B 9/0877 239/333
4,790,454 A * 12/1988 Clark ..... A01C 23/042 222/136
4,821,959 A 4/1989 Browing
5,465,874 A 11/1995 Roach et al.
5,752,661 A * 5/1998 Lewis ..... B05B 9/0861 222/175
5,941,416 A * 8/1999 Balz ..... B67D 7/74 222/1
5,984,143 A 11/1999 Pettis et al.
6,604,546 B1 8/2003 Gilmore
7,905,428 B1 * 3/2011 Probasco ..... A01M 7/0046 239/305
9,079,200 B2 * 7/2015 Fornaro ..... B05B 9/085
2005/0006400 A1 * 1/2005 Shapanus ..... B05B 9/0861 222/1
2011/0142685 A1 6/2011 Gilpatrick
2018/0236472 A1 * 8/2018 Villar Cloquell ..... B05B 9/0811
2019/0030554 A1 * 1/2019 Mantes ..... B05B 9/0888

* cited by examiner

MIX ON DEMAND SMART BACKPACK SPRAYER

CROSS REFERENCE TO RELATED APPLICATIONS

This application is a continuation-in-part of pending U.S. patent application Ser. No. 15/725,937 filed Oct. 5, 2017, and entitled "MIX ON DEMAND SPRAYER," the contents of which are fully incorporated herein.

FIELD OF THE INVENTION

The present invention generally relates to a sprayers, and more particularly to a sprayer configured to dilute a fluid concentrate with a diluent prior to spraying, and still more particularly to a mixing manifold selectively and changeably metered to inject a measured dose of the fluid concentrate into the diluent to produce a mixed fluid with a desired concentrate dilution. In a further aspect of the present invention, the present invention generally relates to sprayers, and more particularly to a backpack sprayer, and still more particularly to a backpack sprayer incorporating smart controls and enhanced fluid control systems.

BACKGROUND OF THE INVENTION

Sprayers, such as broadcast sprayers are used across an array of applications, including farms, golf courses and residential properties, to apply water or other liquids, such as pesticides including herbicides, insecticides and the like. As such, these sprayers may need to cover a large area and, therefore, generally include large tanks strapped to a vehicle, such as an all-terrain vehicle (ATV) or golf cart, or may be mounted onto a tow-behind trailer. Typically in use, these tanks are filled with a selected fluid composition that is to be applied. By way of example, pesticide solutions may be anywhere from about 1% to about 10% active chemical in water. In one scenario, a user may spray a diluted herbicide solution, such as to target thistle. However, to apply a second pesticide solution, such as a diluted insecticide to fruit trees, the user will first have to completely empty the tank of the herbicide solution before rinsing the tank of any residual chemicals and finally refilling the tank with the desired insecticide solution. As may be readily apparent from the above, there are numerous drawbacks to such systems. For example and without limitation, such drawbacks may include waste of chemicals, the need for controlled disposal of unused chemicals, the time consuming need to thoroughly clean the tank between applications and the potential for cross-contamination and application of unwanted chemicals after incomplete or unsuccessful cleaning of the tank.

To alleviate some of the above-referenced drawbacks of broadcast sprayers, systems have been developed which segregate the chemical portion from the water/diluent portion of the system. In such systems, the chemical is stored in a smaller, separate tank than the large water tank. Metering devices may then add chemical to a flow of water prior to emission from a wand or boom sprayer. In this manner, the chemical remains isolated from the water tank, thereby minimizing or avoiding possible contamination of the water source. However, heretofore systems require complex plumbing regimes and interconnectivities of the various components making such systems difficult to use and burdensome to operate and clean.

Broadcast sprayers have also been configured as variable pressure sprayers which may selectively spray fluid from either a spray wand or through a boom-and-nozzle arrangement where multiple nozzles may be supported on a boom. Due to the multiple nozzles within the boom-and-nozzle arrangement, fluid must be delivered at high pressure so as to enable proper spraying at each of the individual nozzles. However, a spray wand uses a single nozzle and may become damaged if it receives high pressure fluid. To that end, current systems typically use pumps with a high pressure cut out switch. These systems are configured with a recirculation manifold whereby excess flow from the pump is diverted back to the supply tank. A valve and pressure gauge is provided on the manifold so the user can tune the percentage of flow going back to the tank while maintaining adequate pressure for the lower flow application (spray wand). Without providing for this recirculation pressure bleed off in the low flow application, pressure would build quickly and rapidly cycle the pressure cut off switch. A situation that is detrimental to both the switch and the pump. However, such a system should not be used in two-tank systems as the mixed fluid exiting the pump would be recycled to the water tank, thereby contaminating the water tank and changing the concentration of the chemical that is being sprayed.

Beyond broadcast sprayers, backpack sprayers are also used to apply water or other liquids, such as pesticides including herbicides, insecticides and the like. As the name implies, backpack sprayers are designed to be worn by the user, such as through securing a tank of the sprayer against the user's back via one or more shoulder straps. A handheld spray wand is fluidly coupled to the tank and is manually actuated, such as through a trigger, to dispense fluid from the tank through the spray wand. Backpack sprayers may be configured as battery-powered, variable pressure pump sprayers that may selectively spray fluid from the spray wand at different pressures. Typically, a positive displacement pump, such as a diaphragm pump, is powered by the battery to draw fluid from the various fluid tanks and deliver the pressurized fluid to the wand nozzle to be sprayed. However, currently available backpack sprayers only afford spraying at differing pressures and do not allow the chemical/diluent ratio to be changed.

Thus, there remains a need for a backpack sprayer with smart controls that also segregates the chemical tank from the water tank while providing selective and variable dilution of the chemical during application. The present invention satisfies this as well as other needs.

SUMMARY OF THE INVENTION

In view of the above and in accordance with an aspect of the present invention, the present invention is generally directed to a sprayer system comprising a first tank configured to hold a diluent; a mounting bracket mounted to the first tank; and a second tank removably mounted to the first tank and configured to hold a liquid concentrate. A mixing manifold is mounted to the mounting bracket and has a first inlet fitting configured to receive a fixed amount of diluent from the first tank and a second inlet configured to receive a selectively adjustable amount of liquid concentrate from the second tank. The fixed amount of diluent and selectively adjustable amount of concentrate are combined to form a mixed solution. The mixing manifold includes a mixed solution outlet and a positive displacement pump is mounted to the mounting bracket and has a suction port fluidly coupled to the mixed solution outlet. A pressure port is configured to fluidly couple with a spray device. The second tank may be separable from the first tank without requiring removal of the mixing manifold or positive displacement pump.

In a further aspect of the present invention, the positive displacement pump is a diaphragm pump and the first inlet fitting further includes a check valve configured to prevent backflow of the mixed solution toward the first tank.

In still another aspect of the present invention, the mixing manifold further includes a disc defining a first annular series of spaced-apart flow-metering holes. Successive respective flow-metering holes have an increasing hole diameter and the disc is adapted to rotate to align a selected flow-metering hole in fluid communication with the second inlet to thereby define the selectively adjustable amount of concentrate in the mixed solution. The disc may further define a second annular series of spaced-apart stop holes. Each respective stop hole within the second annular series radially aligns with a respective flow-metering hole of the first annular series. A single respective stop hole receives a stop member when the selected flow-metering hole is aligned with the second inlet. The stop member may be a ball bearing biased to engage the disc wherein a diameter of the ball bearing is slightly larger than a diameter of each of the stop holes.

In another aspect of the present invention, the first inlet fitting may further include a check valve configured to prevent backflow of the mixed solution toward the first tank and the second tank may be removably mounted to the mounting bracket on the first tank.

In still a further aspect of the present invention, the second tank may include a quick disconnect coupling configured to releasably couple a concentrate tube to a tank fitment defined on the second tank. The concentrate tube may then deliver the liquid concentrate to the mixing manifold. The quick disconnect coupling may comprise a fitment housing having a first end, a second end and a stepped bore region therebetween, wherein the first end is coupled to the tank fitment defined on the second tank. A tubing nut may be removably coupled to the second end of the fitment housing and a tubing coupling may be configured to be received within the tubing nut and abut against a mouth opening defined by the second end of the fitment housing. A plug member may have a plug end, a flanged end and a body portion therebetween. The plug end may be received in the first end of the fitment housing while the flanged end may be received within the second end of the fitment housing and the body portion may extend through the stepped bore region of the fitment housing. A biasing member may also be received within the stepped bore region, wherein the biasing member urges the plug end of the tubing coupling to seal the first end of the fitment housing when the tubing nut is removed from the second end of the fitment housing. A biasing force is stored within the biasing member by the flanged end when the tubing nut is coupled to the second end of the fitting housing, whereby fluid concentrate within the second tank can flow through the quick disconnect coupling to the mixing manifold. The body portion of the plug member may comprise a plurality of spaced apart spindles with open slots defined therebetween to permit flow of fluid concentrate therethrough.

In yet another aspect of the present invention, the sprayer system may further include a pressure by-pass recirculation loop fluidly coupling the pressure port to the suction port. The pressure by-pass recirculation loop may be configured to selectively regulate a fluid pressure of the mixed solution being delivered to the spray device. The pressure by-pass recirculation loop may be either internal to the positive displacement pump or an external pathway around the positive displacement pump.

In accordance with another aspect of the present invention, the present invention is generally directed to a sprayer system comprising a first tank configured to hold a diluent; a mounting bracket mounted to the first tank; and a second tank removably mounted to the first tank and configured to hold a liquid concentrate. A mixing manifold is mounted to the mounting bracket and has a first inlet fitting configured to receive a fixed amount of diluent from the first tank and a second inlet configured to receive a selectively adjustable amount of liquid concentrate from the second tank. The fixed amount of diluent and selectively adjustable amount of concentrate are combined to form a mixed solution. The mixing manifold includes a mixed solution outlet and a positive displacement pump is mounted to the mounting bracket and has a suction port fluidly coupled to the mixed solution outlet. A pressure port may be fluidly coupled to at least one spray device. The second tank may be separable from the first tank without requiring removal of the mixing manifold or positive displacement pump. The at least one spray device may be a low pressure spray nozzle or a high pressure boom carrying two or more boom nozzles. Alternatively, the at least one spray device is a low pressure spray nozzle and a high pressure boom carrying two or more boom nozzles whereby the mixed fluid is selectively received by either the low pressure spray nozzle or the high pressure boom. The sprayer system may further include a pressure by-pass recirculation loop fluidly coupling the pressure port to the suction port. The pressure by-pass recirculation loop may be configured to selectively regulate a fluid pressure of the mixed solution being received by the low pressure spray nozzle. The pressure by-pass recirculation loop may be either internal to the positive displacement pump or an external pathway around the positive displacement pump.

In view of the above and in accordance with an aspect of the present invention, the present invention is generally directed to a backpack sprayer system including a mounting bracket having a battery receiving fixture to receive a battery therein. A first tank is mounted to the mounting bracket and holds a diluent. A second tank is mounted to the mounting bracket and holds a liquid concentrate. A mixing manifold is mounted to the mounting bracket and has a first inlet fitting to receive a fixed amount of diluent from the first tank and a second inlet to receive an adjustable amount of liquid concentrate from the second tank. The fixed amount of diluent and adjustable amount of concentrate are combined to form a mixed solution and the mixing manifold includes a mixed solution outlet. A positive displacement pump is mounted to the mounting bracket and a suction port coupled to the mixed solution outlet and a pressure port fluidly coupled with a spray device. A control unit is mounted on the mounting bracket and receives power from the battery. The positive displacement pump may be a diaphragm pump. The first inlet fitting may also include a check valve configured to prevent backflow of the mixed solution toward the first tank.

In a further aspect of the present invention, the mixing manifold further includes a disc defining a first annular series of spaced-apart flow-metering holes. Successive respective flow-metering holes have an increasing hole diameter and the disc is adapted to rotate to align a selected flow-metering hole of the annular series of spaced-apart holes in fluid communication with the second inlet to thereby define the selectively adjustable amount of concentrate in the mixed solution. The disc may further define a second annular series of spaced-apart stop holes. Each respective stop hole within the second annular series radially aligns with a respective flow-metering hole of the first annular series. A single respective stop hole receives a stop member when the selected flow-metering hole is aligned with the second inlet. The stop member may be a ball bearing biased to engage the disc, wherein a diameter of the ball bearing is slightly larger than a diameter of each of the stop holes.

In still another aspect of the present invention, a battery may be removably secured within the battery receiving fixture. The battery is operably coupled to the positive displacement pump and control unit whereby the battery is configured to provide power to the positive displacement pump and control unit when the sprayer system is in an on configuration.

In another aspect of the present invention, the second tank is fixedly secured within the first tank, whereby an open volume defined by the second tank is fluidly isolated from an open volume defined by the first tank. The second tank may also include a concentrate fitting configured to receive a first end of a concentrate tube. The second end of the concentrate tube is coupled to the second inlet of the mixing manifold. The first tank may also include a diluent fitting configured to receive a first end of a diluent tube. The second end of the diluent tube is coupled to the first inlet of the mixing manifold. The second tank may further include a liquid level gauge.

In still a further aspect of the present invention, the control unit comprises a printed circuit board and a control panel interface. The printed circuit board includes a processor and a memory, wherein the processor is configured to perform one or more functions including power on/power off, regulating power to the positive displacement pump so as to vary output pressure of the mixed solution, monitoring and displaying a battery charge level, and indicating pacing. The control panel interface is coupled to the printed circuit board and includes one or more control buttons whereby a user may selectively control the processor functions.

Additional objects, advantages and novel aspects of the present invention will be set forth in part in the description which follows, and will in part become apparent to those in the practice of the invention, when considered with the attached figures.

DETAILED DESCRIPTION OF THE PREFERRED EMBODIMENTS

Figure 1:
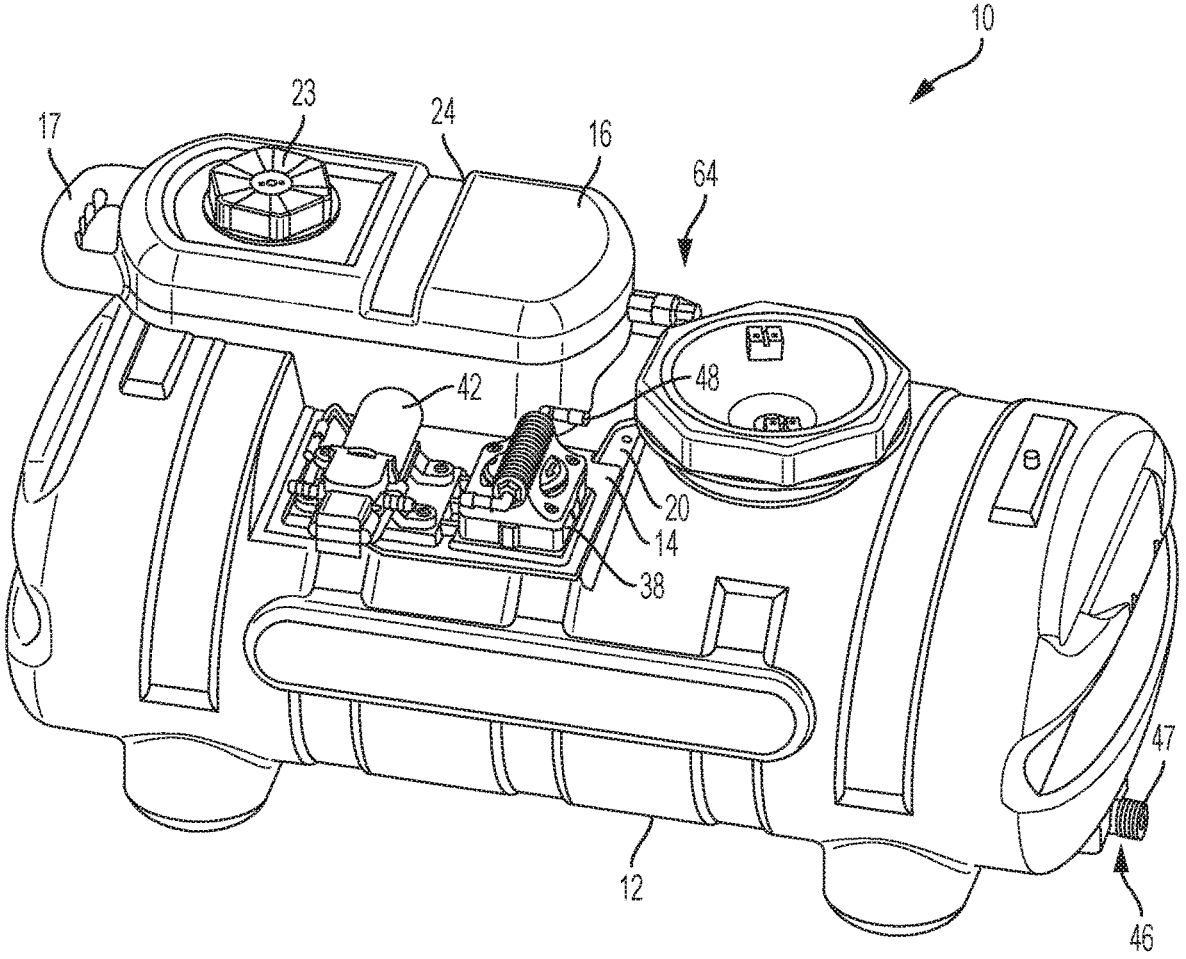
FIG. 1 is a perspective view of a sprayer system in accordance with an aspect of the present invention.
Figure 2:
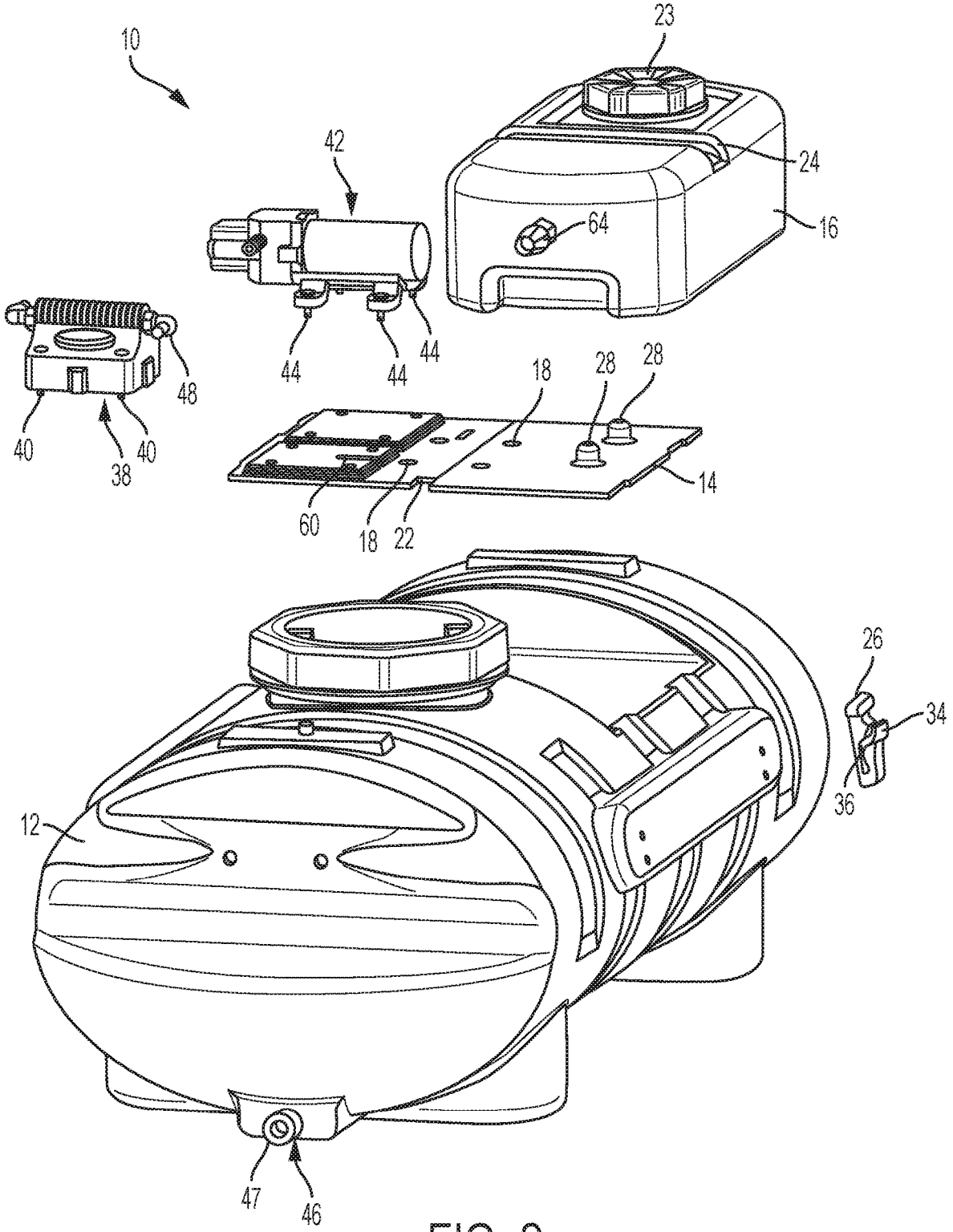
FIG. 2 is an exploded view of the sprayer system shown in FIG. 1.

Referring now to FIGS. 1 and 2, in accordance with an aspect of the present invention, sprayer system 10 may generally comprise a first tank 12, mounting bracket 14, second tank 16, mixing manifold 38 and positive displacement pump 42, such as and without limitation thereto, a diaphragm pump. Mounting bracket 14 may be mounted to first tank 12, such as via mechanical fasteners 18. To provide further support and to resist lateral movement of mounting bracket 14 in the x-z plane, first tank 12 may include a tang 20 configured to reside within a notch 22 defined within mounting bracket 14. Second tank 16 may be mounted to first tank 12 and mounting bracket 14, such as via a strap (not shown). To that end, second tank 16 may include a strap recess 24 configured to receive the strap and first tank 12 may further include a strap tie down clamp 26 whereby movement of second tank 16 in the y-axis is prohibited. To minimize lateral displacement of second tank 16 (i.e., in the x-z plane) mounting bracket 14 may include one or more upwardly extending nodules 28 configured to coincide with matching indentations 30 defined on bottom wall 32 of second tank 16 (see FIG. 6). In this manner, a user may unfasten the strap and lift second tank away from mounting bracket 14 and first tank 12, such as via handle 17, without requiring the use of tools. Strap tie down clamp 26 may further include a wand receiving portion 34 defining a wand receiving recess 36 whereby a spray wand (not shown) may be releasably coupled to sprayer system 10 when the spray wand is not in use. With continued reference to FIGS. 1 and 2, and with additional reference to FIGS. 3 and 4, a mixing manifold 38 may be mounted to mounting bracket 14, such as via mechanical fasteners 40, and positive displacement pump 42 may be mounted to mounting bracket 14 such as via mechanical fasteners 44. In this manner, each of the second tank 16, mixing manifold 38 and positive displacement pump 42 may be individually and separately removed from mounting bracket 14 and first tank 12.

Figure 10:
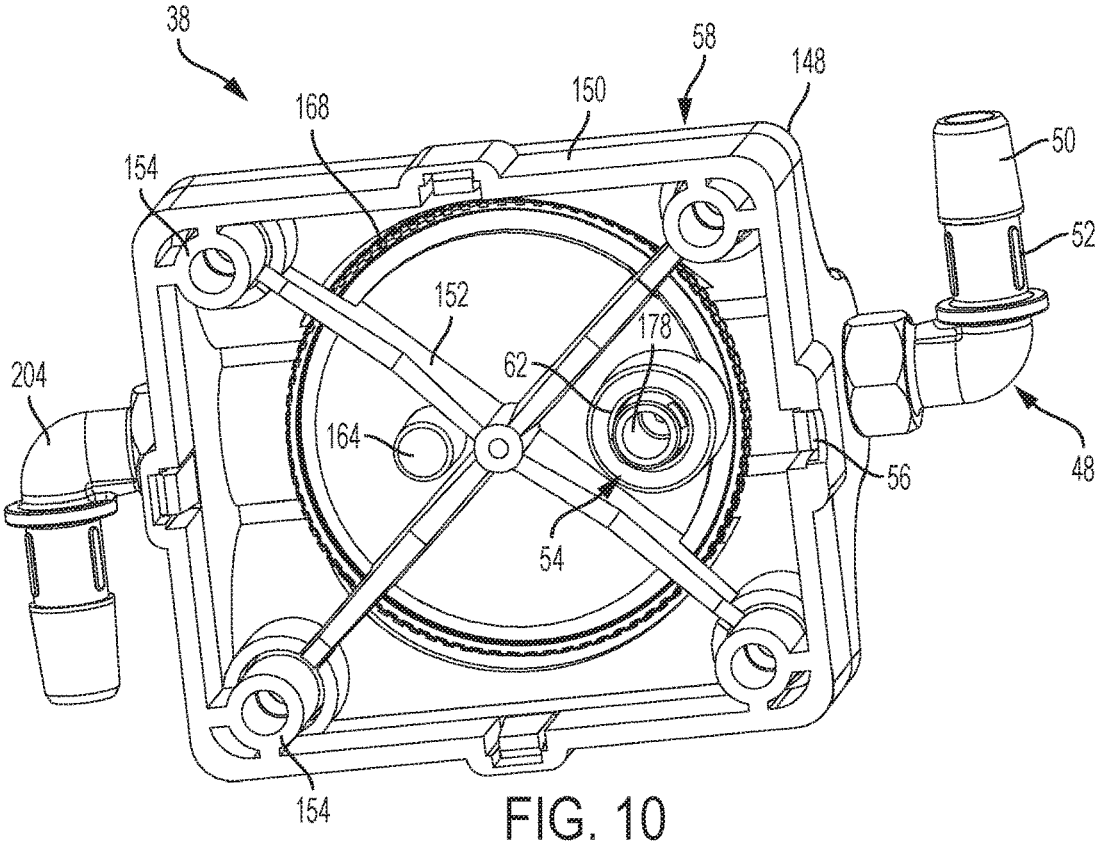
FIG. 10 is a bottom perspective view of the mixing manifold shown in FIG. 9.
Figure 11:
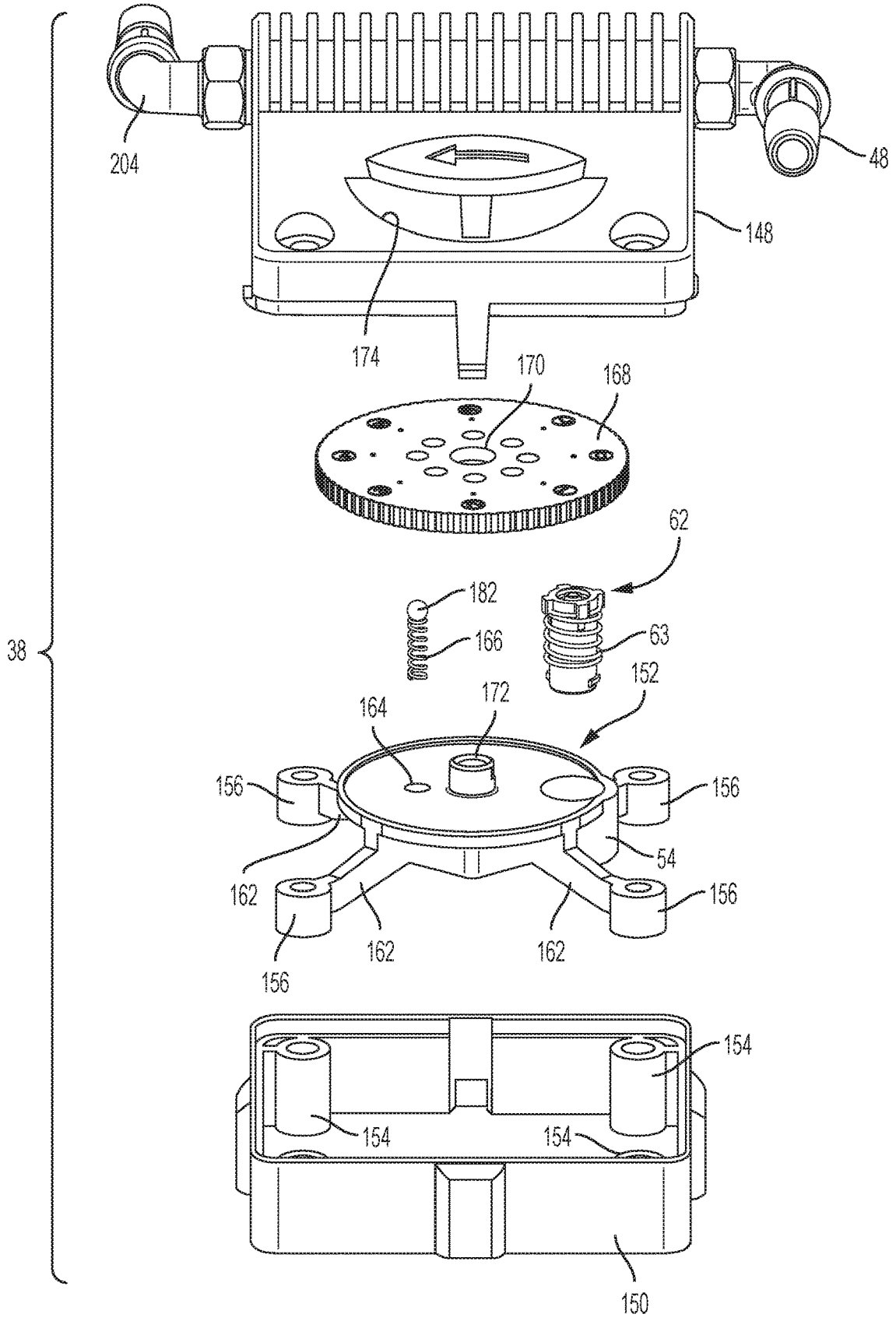
FIG. 11 is a top front exploded view of the mixing manifold shown in FIGS. 9 and 10.
Figure 12:
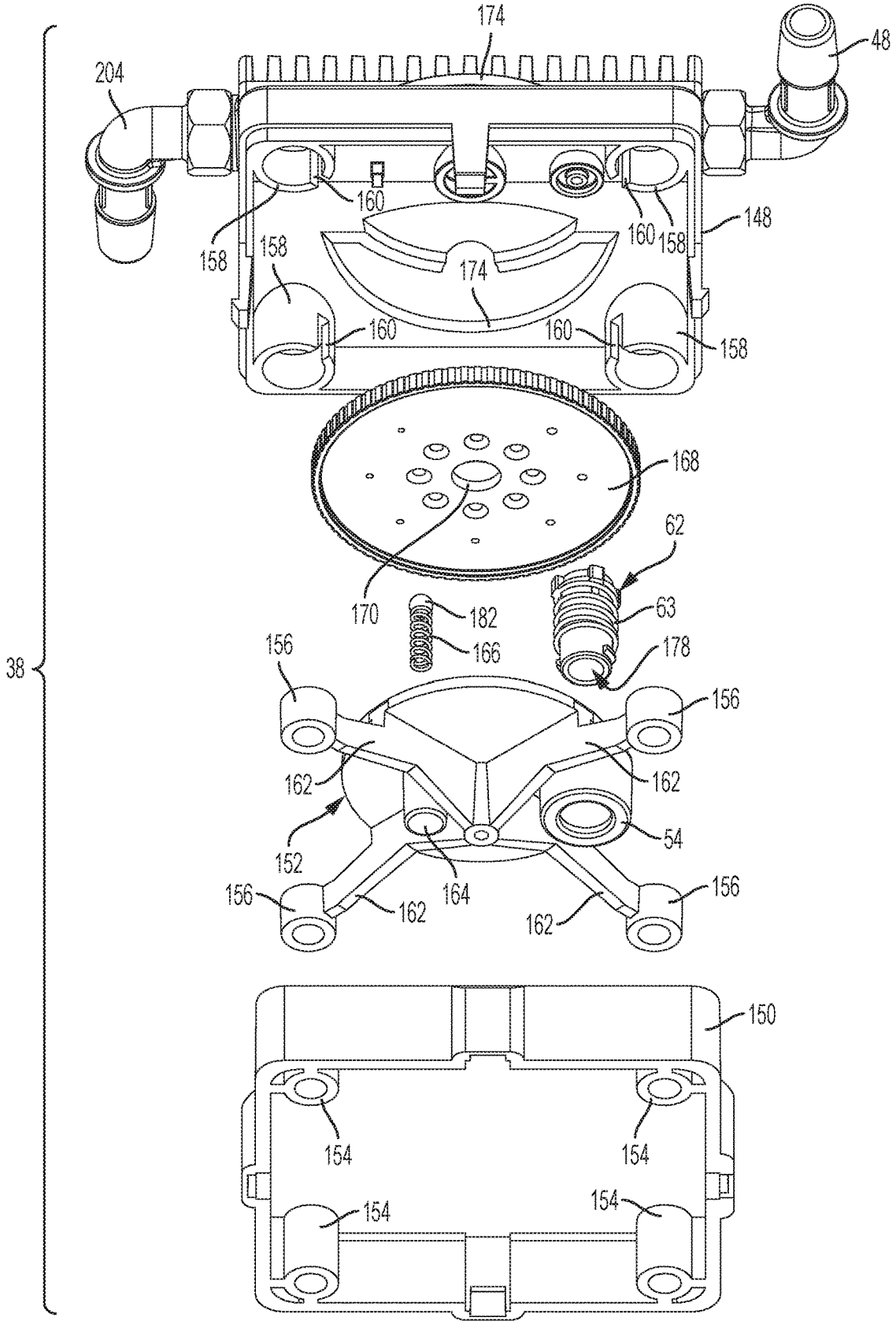
FIG. 12 is a bottom front exploded view of the mixing manifold shown in FIGS. 9 and 10.

In operation, first tank 12 includes a diluent outlet 46 having a diluent fitting 47 configured to receive one end of diluent tubing (not shown) in a substantially fluid-tight seal. The opposing end of the diluent tubing is mounted onto a first inlet fitting 48 of mixing manifold 38 (see also FIGS. 9-13). First inlet fitting 48 may include a tapered nipple 50 and ribbed portion 52 so as to snuggly receive the diluent tubing thereon in a substantially fluid-tight seal. An optional hose clamp (not shown) may also be used to more securely clamp the diluent tubing to ribbed portion 52. Mixing manifold 38 may further include a second inlet 54 configured to receive concentrate tubing (not shown) from second tank 16. As shown most clearly in FIGS. 4 and 10, mixing manifold 38 may include a notch 56 proportioned to permit passage of concentrate tubing through housing 58 of mixing manifold 38. Mounting bracket 14 may also include a recess 60 to accommodate passage of the concentrate tubing (see FIGS. 2 and 4). Thus, a first end of the concentrate tubing may be mounted to fitment 62 housed within second inlet 54. The concentrate tubing may then extend toward second tank 16 wherein the opposing end of the concentrate tubing is mounted to second tank 16 via concentrate outlet fitting 64.

Figure 5:
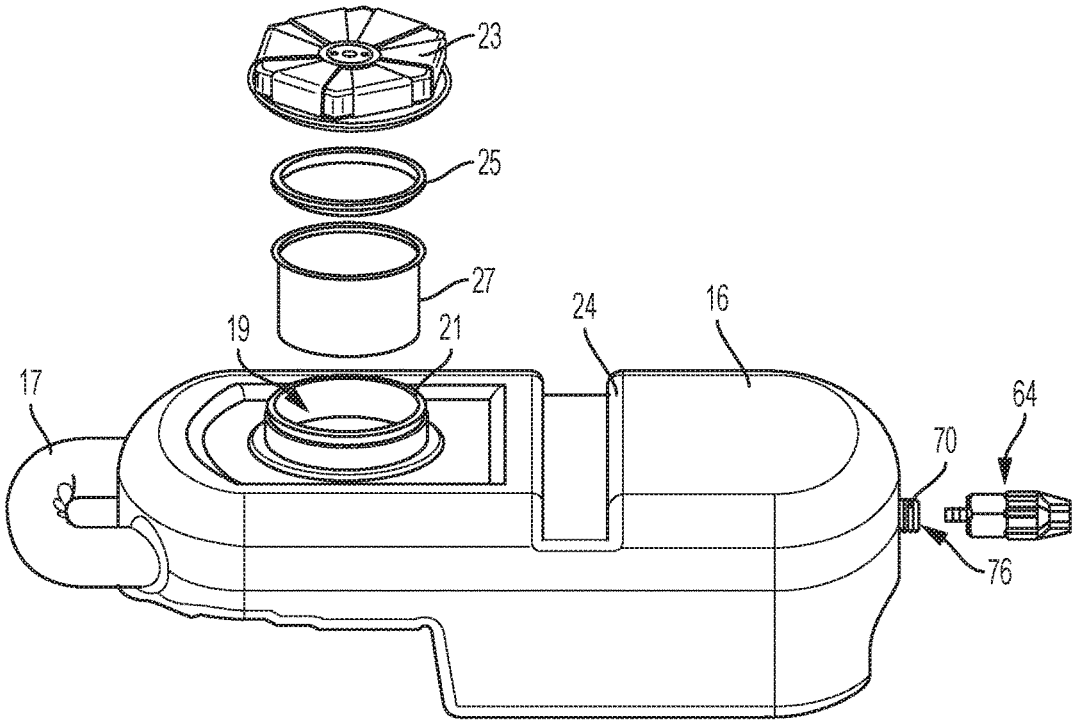
FIG. 5 is an exploded view of a liquid concentrate tank used within the sprayer system shown in FIG. 1.
Figure 6:
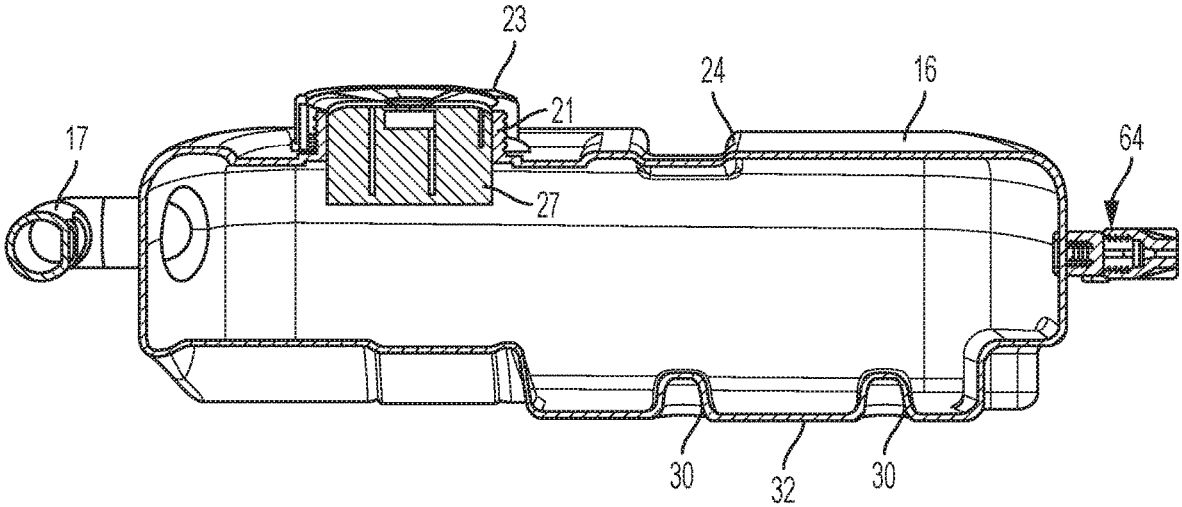
FIG. 6 is a cross section view of the liquid concentrate tank used within the sprayer system shown in FIG. 1.

With reference to FIGS. 5 and 6, second tank 16 may be filled with a selected fluid concentrate through tank opening 19 defined by a threaded mouth portion 21. A cap 23 may be removably threaded onto mouth portion 21 so as to seal second tank 16. An optional O-ring 25 may also facilitate a fluid-tight seal between second tank 16 and cap 23. To prevent clogging of downstream plumbing components, mouth portion 21 may further receive filter element 27 therein. When filling second tank 16 with fluid concentrate, the fluid will pass through filter element 27 whereby particulate matter larger than the pore size of the filter element will be strained out of the fluid. Accordingly, the pore size of filter element 27 should be selected so as to be smaller than the internal diameter of the smallest diameter downstream component, such as disc 168 which will be discussed in greater detail below.

Figure 7:
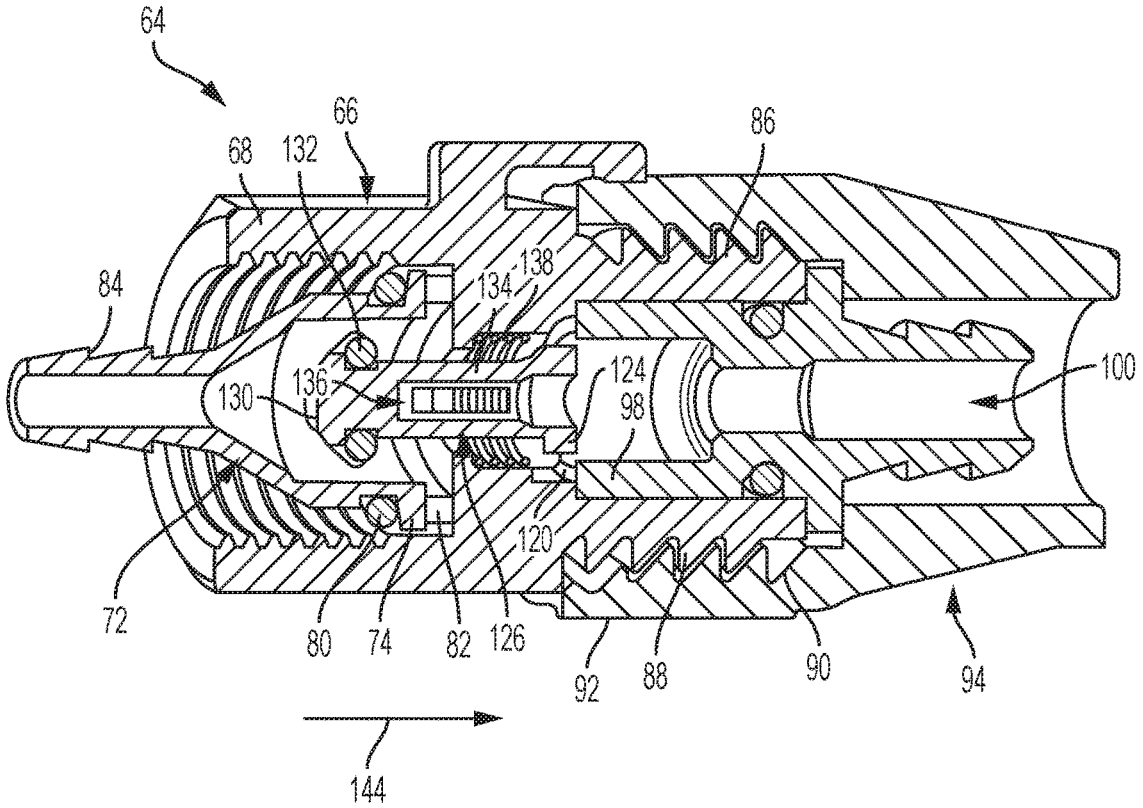
FIG. 7 is a cross section view of a tubing fixture used with the liquid concentrate tank shown in FIG. 5.
Figure 8:
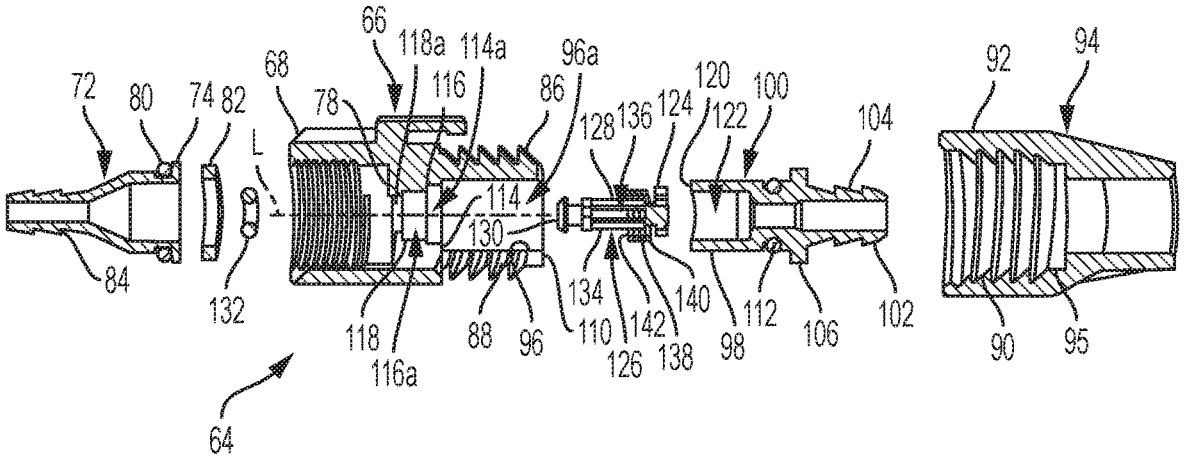
FIG. 8 is an exploded cross section view of the tubing fixture shown in FIG. 7.
Figure 9:
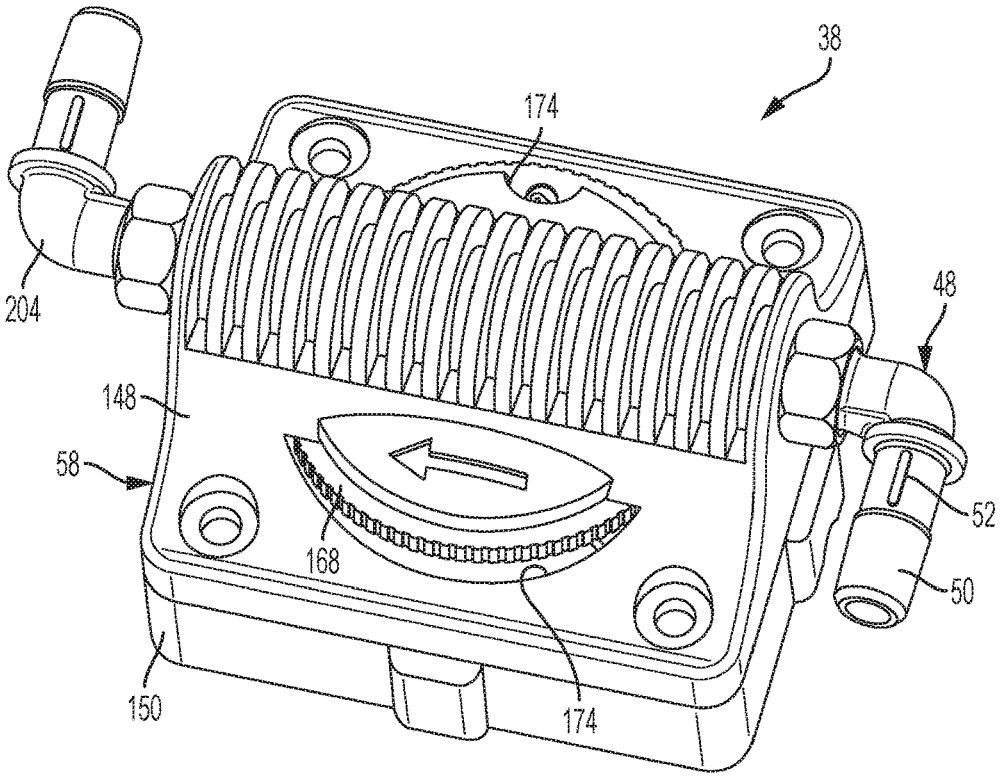
FIG. 9 is a top perspective view of a mixing manifold used within the sprayer system shown in FIG. 1.

With reference to FIGS. 7 and 8, to facilitate tool-less removal of second tank 16 from mounting bracket 16 and mixing manifold 38, concentrate outlet fitting 64 may be a quick disconnect coupling generally comprised of a fitment housing 66 having a first end 68 configured to be threadably coupled to a corresponding tank fitment 70 defined on second tank 16 (see FIG. 5). First end 68 of fitment housing 66 may also be configured to receive a tank tubing coupling 72 whereby tank tubing coupling 72 includes a flanged end 74 proportioned to abut against mouth opening 76 of tank fitment 70 such that tank tubing coupling 72 is entrapped between mouth opening 76 and stepped wall 78 of fitment housing 66 when fitment housing 66 is threaded onto tank fitment 70. To promote a fluid-tight seal between tank fitment 70 and fitment housing 66, one or more seals, such as O-rings 80, 82 may be included. The opposing end of tank tubing coupling 72 may include one or more barbs 84 dimensioned to snuggly receive a concentrate pick-up tube (not shown) which may extend from tank tubing coupling 72 to proximate bottom wall 32 of second tank 16. In this manner, liquid concentrate may be drawn from second tank 16 as will be described in greater detail below.

With continued reference to FIGS. 7 and 8, second end 86 of fitment housing 66 may include male threads 88 configured to threadably engage female threads 90 defined within a first end 92 of tubing nut 94. Second end 86 may further define a bore 96 dimensioned to receive a first end 98 of a concentrate tubing coupling 100 therein upon threaded engagement of tubing nut 94 with fitment housing 66. The opposing end 102 of concentrate tubing coupling 100 may include one or more barbs 104 dimensioned to snuggly receive the opposing end of the concentrate tubing as described above. Annular flange 106 on concentrate tubing coupling may engage seat portion 95 of tubing nut 94 such that tubing nut 94 may permit mounting of concentrate tubing coupling 100 to second tank 16 with minimal, if any, twisting of the concentrate tubing as tubing nut 94 is rotatably threaded onto male threads 88. To assist in properly seating concentrate tubing coupling 100 within fitment housing 66, annular flange 106 may also be dimensioned to abut against the mouth opening 110 of bore 96 when tubing nut 94 is fully tightened. An O-ring seal 112 may also promote a fluid-tight seal between concentrate tubing coupling 100 and bore 96 of fitment housing 66.

In a further aspect of the invention, bore 96 may be further include a series of steps 114, 116, 118 thereby defining bore regions 96*a*, 114*a*, 116*a*, 118*a*. Concentrate tubing coupling 100 may reside within bore region 96*a* such that terminal end 120 of first end 98 of concentrate tubing coupling 100 may seat against step 114. The wall thickness of terminal end 120 may be selected so that internal bore 122 of concentrate tubing coupling 100 is slightly smaller than the diameter of bore region 114*a*. In this manner, terminal end 120 partially occludes bore region 114*a* whereby flanged end 124 of plug member 126 may be engaged by concentrate tubing coupling 100 as tubing nut 94 is threaded onto fitment housing 66. Bore region 114*a* may be proportioned to receive flanged end 124 while step 116 has a smaller diameter than flanged end 124 whereby flanged end 124 is precluded from entering bore region 116*a*. Plug member 126 may further include a body portion 128 dimensioned to pass through and extend within bore regions 116*a*, 118*a* before terminating at a second end 130. Second end 130 of plug member 126 may include an O-ring seal 132 having an external diameter greater that the diameter of bore region 118*a*. In one aspect of the invention, body portion 128 may be comprised of a plurality of spaced-apart spindles 134 configured to define open slots 136 therebetween so as to promote fluid travel through plug member 126, as will be discussed in greater detail below.

Plug member 126 may translate along longitudinal axis L of fitment housing 66 so as to selectively plug or unplug bore region 118*a* and control outflow of liquid concentrate from second tank 16 to mixing matrix 38. To that end, as shown in FIG. 7, tubing nut 94 may be threadably coupled to fitment housing 66 to thereby secure concentrate tubing coupling 100 therein. Terminal end 120 of concentrate tubing coupling 100 engages flanged end 124 of plug member 126 so as to direct second end 130 a spaced distance from bore region 118*a*. In this position, fluid may flow from second tank 16 through tank tubing coupling 72, fitment housing 66 and the concentrate tubing coupling before passing to mixing manifold 38.

Fitment housing 66 may further include a biasing member, such as compression spring 138, configured to engage flanged end 124 at a first end 140 and step 118 at second end 142. In this manner, threading of tubing nut 94 and concentrate tubing coupling 100 may compress spring 138 to thereby cause potential energy to be stored within spring 138. Unthreading of tubing nut 94 and removal of concentrate tubing coupling 100 from fitment housing 66 enables spring 138 to release the stored potential energy so as to cause plug member 126 to translate along longitudinal axis L generally in the direction generally indicated by arrow 144. Plug member 126 will continue to translate until O-ring 132 engages surface 146 of fitment housing 66 whereby O-ring 132 and second end 130 of plug member 126 occlude bore region 118*a*. In this manner, fluid concentrate may no longer flow into concentrate tubing coupling 100. As a result, second tank 16 may be rendered substantially leak proof. Second tank 16 may then be removed from mounting bracket 14 as described above and stored with minimal to no loss of liquid concentrate.

In accordance with an aspect of the invention, following removal of second tank 16 as described above, a replacement second tank (not shown) may be mounted to mounting bracket 14. Tubing nut 94 and concentrate tubing coupling 100 may then be threaded onto a fitment housing (similar to fitment housing 66) on the replacement second tank as described above. As a result, the plug member within the fitment housing may be opened so as to allow transfer of the alternative liquid concentrate within the replacement second tank to mixing manifold 38 as described above. In a further aspect of the invention, a replacement second tank may be filled with water so as to enable flushing of the system between chemicals that are to be sprayed, thereby reducing cross-contamination or misapplication of the chemicals. Thus, sprayer system 10 may be configured to selectively spray any number of various liquid concentrates requiring only the removal and replacement of selected second tanks and remounting of tubing nut 94 and concentrate tubing coupling 100. Respective second tanks may be stored with little to no threat of leakage of respective liquid concentrates contained therein, thereby reducing waste of the concentrates. Moreover, user exposure to a concentrate is minimized as the second tank does not need to be emptied, washed and refilled every time a new liquid concentrate desired to be sprayed.

Turning now to FIGS. 9-13, various views of mixing manifold 38 are shown. As can be seen, housing 58 of mixing manifold 38 may be generally comprised of upper 148 and lower 150 housing subunits. Manifold support member 152 may be interposed between subunits 148, 150. To that end, the interior corners of lower housing subunit 150 may include nodules 154 dimensioned such that respective feet 156 on manifold support member 152 seat upon respective nodules 154. Upper housing subunit 148 may include respective lobes 158 dimensioned to receive a respective foot 156 therein. Each lobe 158 may also include a notch 160 for permitting passage therethrough of a respective leg 162 on manifold support member 152. In this manner, manifold support member 152 may be securely seated within manifold housing 58 and be constrained so as to prevent lateral and torsional movement of manifold support member 152. As described above, manifold support member 152 includes second inlet 54 configured to receive fitment 62. Manifold support member 152 may further include a spring well 164 dimensioned to receive a stop spring 166, as will discussed in greater detail below.

Figure 14:
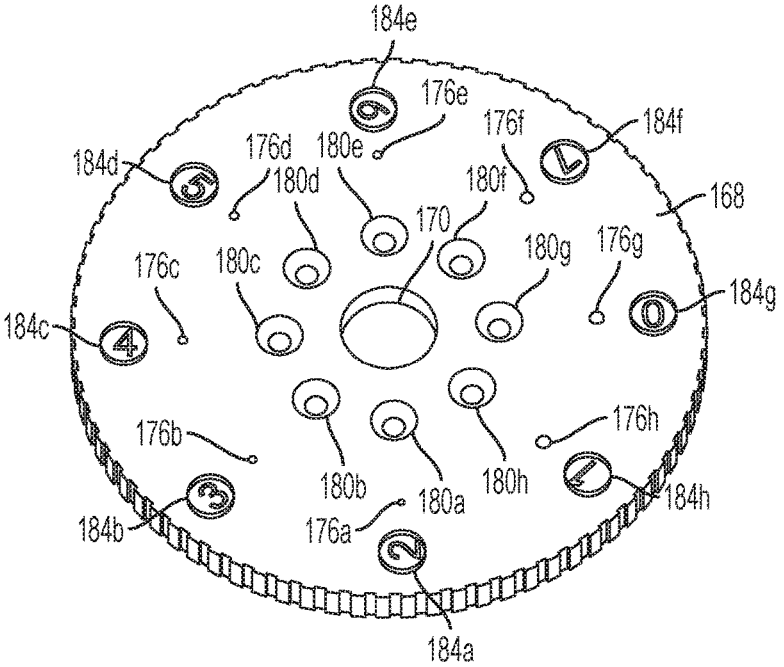
FIG. 14 is an isolated view of a disc used within the mixing manifold shown in FIGS. 9 through 13.

Mixing manifold 38 may further include disc 168 rotatably mounted atop manifold support member 152 whereby center hole 170 defined by disc 168 receives post 172 formed on manifold support member 152. Disc 168 may then be capped by upper housing subunit 148 wherein upper housing subunit 148 includes one or more openings 174 therethrough such that a portion of the outer circumference of disc 168 may be engaged by a user so as to selectively rotate disc 168 about post 172. With additional reference to FIG. 14, disc 168 may further define an outer annular series of spaced-apart through-holes, such as flow metering holes 176*a*-176*h*. Each of flow metering holes 176*a*-176*h* may have a slightly larger diameter than the immediately preceding flow metering hole. In operation one of holes 176*a*-176*h* is aligned with internal bore 178 defined by fitment 62. Fitment spring 63 may urge fitment 62 against disc 168 so as to create and maintain a substantially fluid-tight seal between fitment 62 and disc 168. In this manner, a user may selectively control the volume of liquid concentrate that may pass through disc 168, as will be discussed in greater detail below.

Disc 168 may also further define an inner annular series of spaced apart through-holes, such as chamfered spring stop holes 180*a*-180*h*. Each respective spring stop hole 180*a*-180*h* is configured to align radially with its respective flow metering hole 176*a*-176*h*. In operation, a selected one of holes 180*a*-180*h* is aligned with spring well 164 whereby a positive stop member, such as ball bearing 182, seats within a portion of the selected spring stop hole 180*a*-180*h* through urging of stop spring 166 resident within spring well 164. In this manner, a user may receive feedback indicating proper alignment of the selected flow metering hole 176*a*-176*h* upon seating of ball bearing 182. To change the amount of liquid concentrate added to the diluent stream, a user may rotate disc 168 whereby disc 168 may apply downward force against ball bearing 182 so as to compress stop spring 166 within spring well 164. Disc 168 may then be further rotated until the desired flow metering hole 176*a*-176*h* is aligned with internal bore 178 of fitment 62 such that ball bearing 182 seats within the desired spring stop hole 180*a*-180*h*. As most clearly shown in FIG. 14, disc 168 may also include respective indicia 184*a*-184*h* proximate a respective flow metering hole 176*a*-176*h*. Indicia 184*a*-184*h* may correlate with the respective diameter of respective flow metering holes 176*a*-176*h* so as to provide visual indication to the user as to which of the respective flow metering holes 176*a*-176*h* is currently aligned with internal bore 178 of fitment 62.

Figure 13:
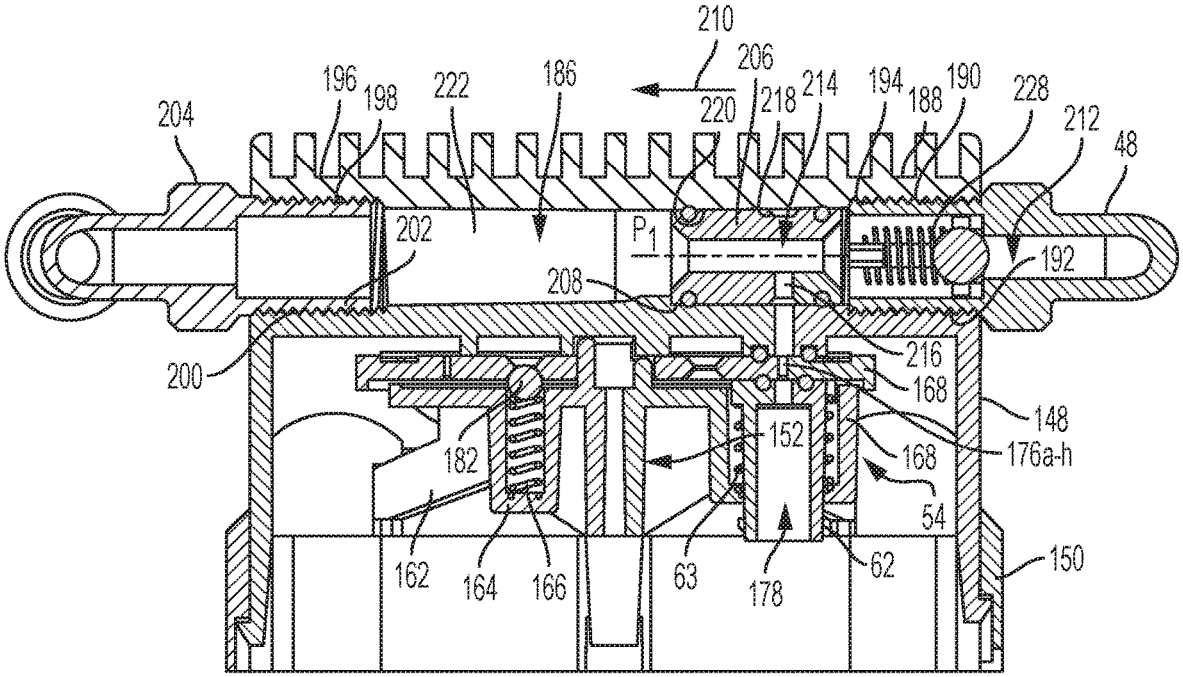
FIG. 13 is a cross section view of the mixing manifold, taken generally along line 13-13 in FIG. 9.

As seen most clearly in FIG. 13, mixing manifold 38 may include a fluid channel 186 wherein a first end 188 of fluid channel 186 may define female threads 190 configured to matingly receive corresponding male threads 192 defined by manifold terminus 194 of first inlet fitting 48. The opposing second end 196 of fluid channel 186 may similarly define female threads 198 configured to matingly receive corresponding male threads 200 on manifold terminus 202 of manifold outlet fitting 204. A flow plug 206 may be interposed within fluid channel 186 adjacent the internal extent of female threads 190. Fluid channel 186 may further define a step 208 so as to provide a positive stop to insertion of flow plug 206 in the direction generally indicated by arrow 210. In this manner, bore 212 of first inlet fitting 48 may align with the longitudinal axis P of longitudinal bore 214 of flow plug 206 whereby a constant volume of diluent may be received from first tank 12 after flowing through first inlet fitting 48 into flow plug 206.

As further seen in FIG. 13, flow plug 206 may further include a radially extending bore 216 which may be configured to fluidly align with one of flow metering holes 176*a*-176*h* and internal bore 178 of fitment 62. In this manner, a user selected volume of liquid concentrate may be received from second tank 16, wherein the selected volume of liquid concentrate is then mixed with, and diluted by, the constant volume of diluent being received through first inlet 48 as described above. Flow plug 206 may also define an annular groove 218 configured to define a fluid tight channel with internal wall surface 220 of mixing manifold 38.

Annular groove 218 coincides with radially extending bore 216 such that fluid concentrate may still pass through radially extending bore 216 into longitudinal bore 214 should radially extending bore 216 be misaligned with one of flow metering holes 176*a*-176*h* and internal bore 178. Fluid channel 186 may further define a mixing chamber portion 222 which may further promote mixing of the diluent and fluid concentrate prior to outputting the mixed fluid through manifold outlet fitting 204.

Figure 3:
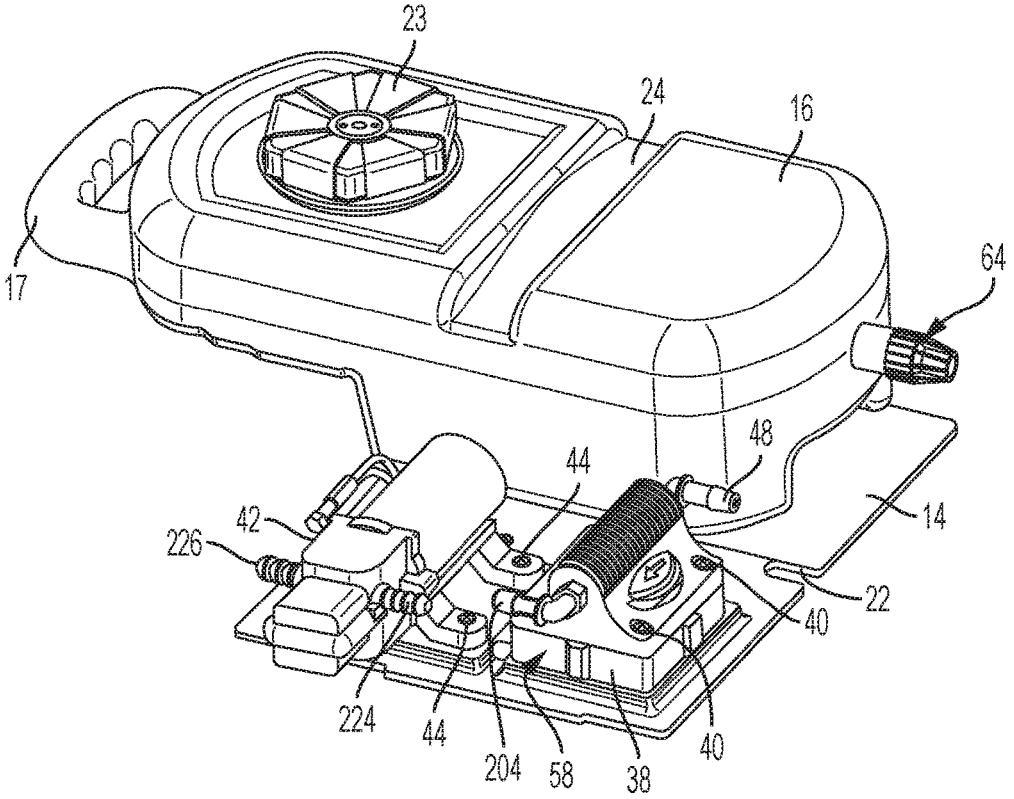
FIG. 3 is a front perspective view of the sprayer system shown in FIG. 1 with the diluent tank removed.
Figure 4:
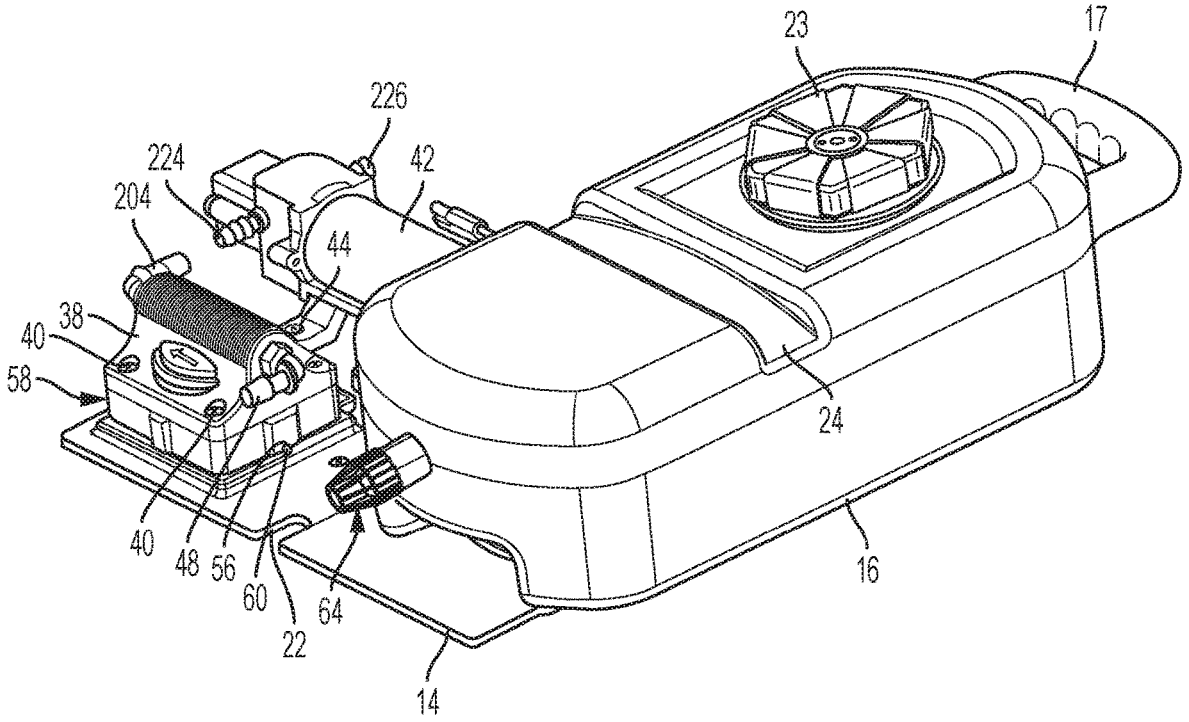
FIG. 4 is a rear perspective view of the sprayer system shown in FIG. 3.

With reference to FIGS. 3 and 4, manifold outlet tubing (not shown) may fluidly couple manifold outlet fitting 204 with positive displacement pump suction port 224. In this manner, upon a suction stroke of positive displacement pump 42, mixed fluid is drawn into pump 42 from mixing manifold 38. As described above, the mixed fluid is comprised of a constant volume of diluent into which is charged a user-selected volume of liquid concentrate. Thus, on a pressure stroke of pump 42, the mixed fluid is forced out of pressure port 226 of positive displacement pump 42. Pressure port 226 may be fluidly coupled to a spray device, such as a spray wand or boom sprayer (not shown). To prevent backflow of mixed fluid through first inlet fitting 48 into first tank 12, first inlet fitting 48 may include a check valve 228 (see FIG. 13). In this manner, cyclical operation of positive displacement pump 42 will alternately draw mixed fluid from mixing manifold 38 and discharge this mixed fluid through an attached sprayer whereby the concentration of the fluid concentrate dilution is selected, and easily modified by, the user through setting of disc 168. In should be understood by those skilled in the art that positive displacement pump 42 may be powered by any suitable power source, such as a dedicated battery or through wiring pump 42 to the battery of the vehicle (e.g., ATV or golf cart).

Figure 15:
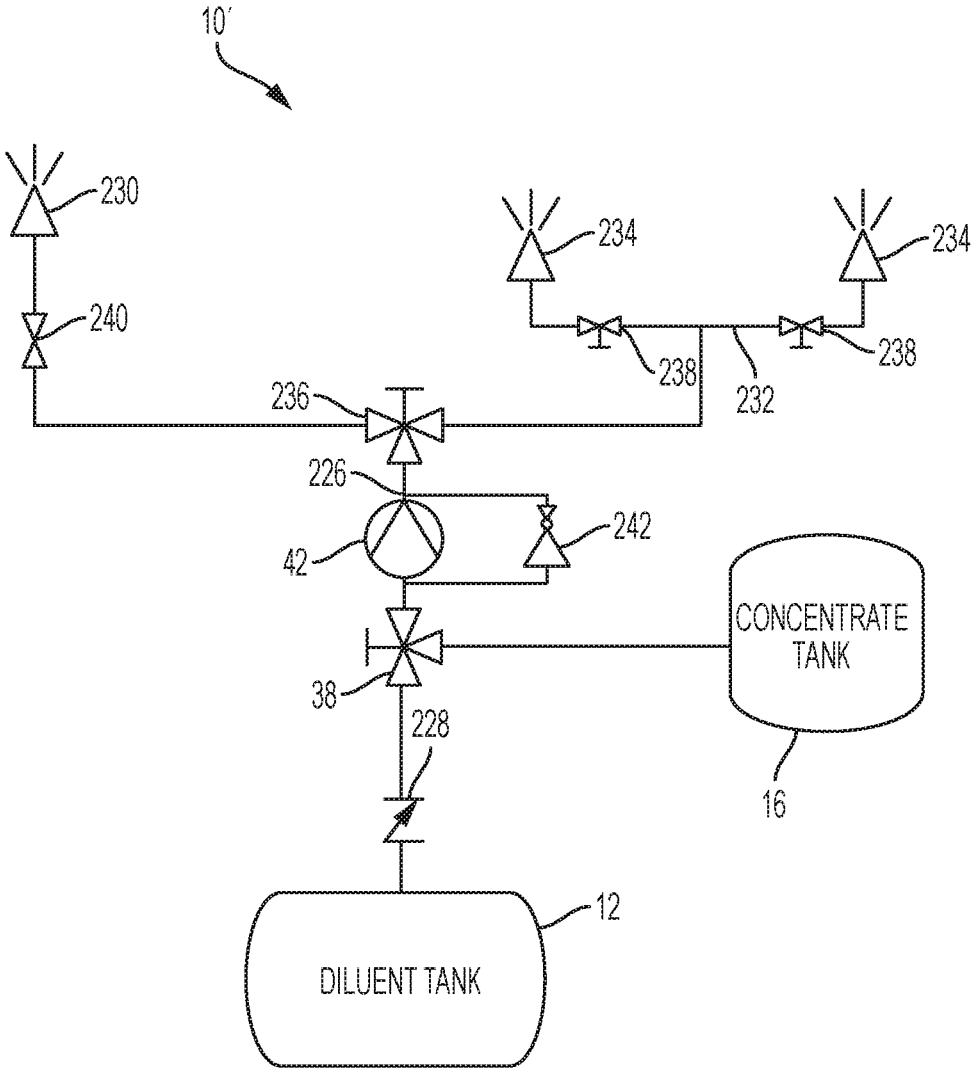
FIG. 15 is a schematic view of a pressure by-pass system suitable for use within a variable pressure sprayer system in accordance with an aspect of the present invention.

Turning now to FIG. 15, a sprayer system 10' may be configured to operate as a variable pressure sprayer. Sprayer system 10' may include first tank 12 and second tank 16 each fluidly coupled to mixing manifold 38 as described above with regard to sprayer system 10. Check valve 228 may be interposed between mixing manifold 38 and first tank 12 to prevent backflow of mixed fluid into first tank 12, also as described above. Mixed fluid may be drawn from mixing manifold 38 through operation of positive displacement pump 42 whereby the mixed fluid is output through pressure port 226. The mixed fluid may then be selectively delivered to a spray nozzle 230 (such as a handheld sprayer) or to a boom 232 upon which are mounted a plurality of boom nozzles 234.

In accordance with one aspect of the invention, flow to spray nozzle 230 or boom 232 may be selectively controlled by a selector valve 236. Flow control at each boom nozzle 234 may also be further controlled by respective ball valve 238. Spray nozzle 230 may also include a pressure reducing valve 240 which is metered to control the fluid pressure of the mixed fluid entering spray nozzle 230 so as to minimize or prevent damage to spray nozzle 230.

Positive displacement pump 42 may include a pressure by-pass recirculation loop 242 fluidly coupling pressure port 226 with suction port 224. Pressure by-pass recirculation loop 242 may operate to decrease the fluid pressure of the mixed fluid being delivered to spray nozzle 230 while also maintaining segregation of the mixed fluid from either first tank 12 or second tank 16. Pressure by-pass recirculation loop 242 may be either internal to positive displacement pump 42 of may be en external pressure by-pass loop around positive displacement pump 42.

Referring now to FIGS. 16 through 24, in accordance with a further aspect of the present invention, a backpack sprayer system 300 may generally comprise a first tank 312 and second tank 316 mounted onto a mounting bracket 314. Backpack sprayer system 300 may further include a mixing manifold 38 and positive displacement pump 42, such as those described above with regard to spray system 10.

As shown most clearly in FIGS. 16-19, 22, 24, mounting bracket 314 include a mounting plate 318 and extended upper sidewall portion 320. In this manner, mounting bracket 314 may receive first tank 312 within upper sidewall portion 320 whereby bottom wall 312*a* of first tank 312 sits upon mounting plate 318. As further shown in FIGS. 22 and 24, second tank 316 may be defined by a sidewall 322 and bottom wall 324. In one aspect, second tank 316 may reside within, and be fixedly secured to, first tank 312, although it should be noted that in other embodiments, second tank 316 may be separable from first tank 312. Rear wall 312*b* of first tank 312 and rear wall 314*b* of mounting bracket 314 may have a curved profile so as to more ergonomically rest against a user's back during use. To secure backpack sprayer system 310 to the user's back, sides 314*c*, 314*d* of mounting bracket 314 may include a strap clip 326. In this manner, first ends of respective straps (not shown) may be secured to a respective strap clip 326. The opposing second end of each strap may then be secured to tank clip 328 mounted on top wall 312*c* of first tank 312. The straps may be worn over the user's shoulders so as to hold backpack sprayer system 310 against the back of the user.

Figure 18:
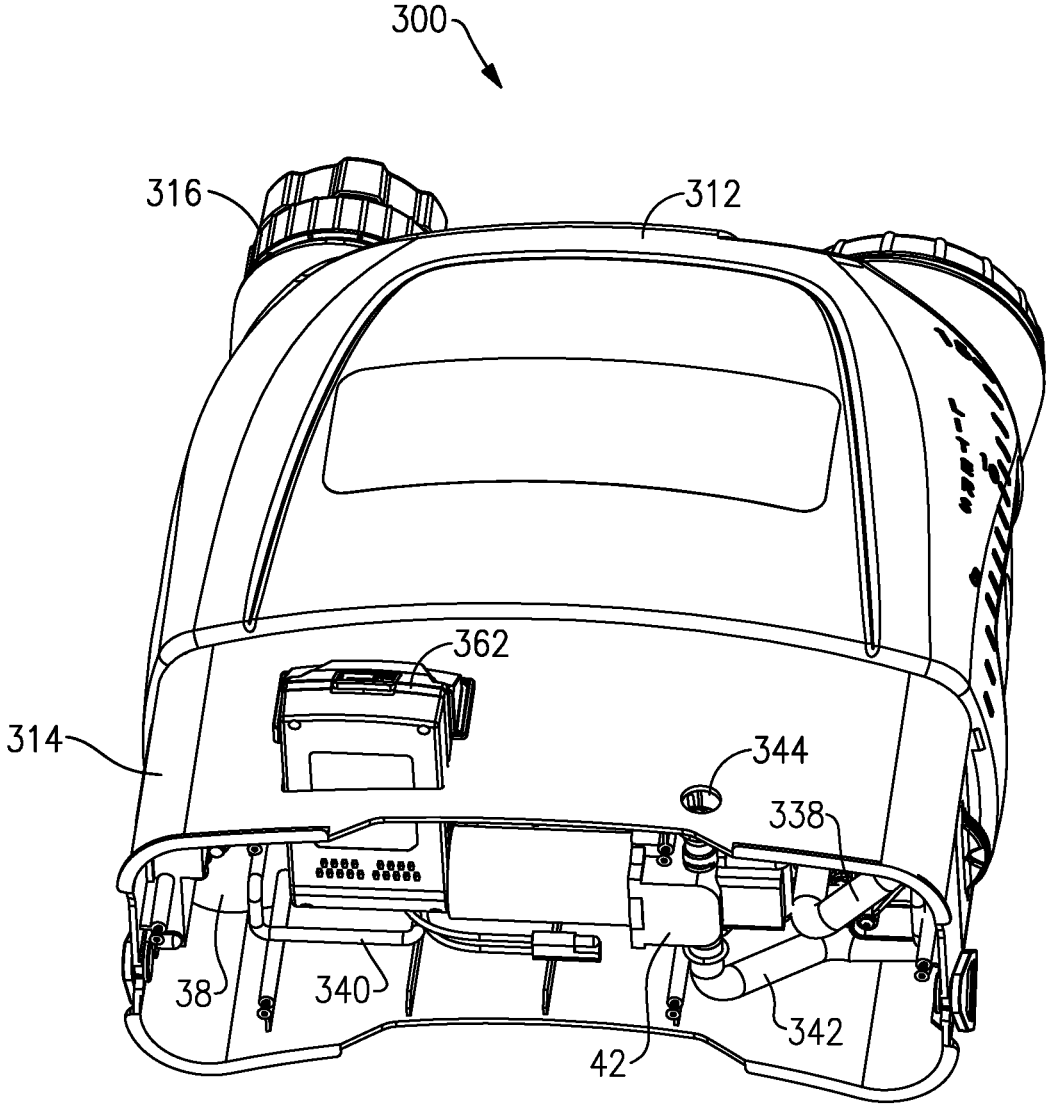
FIG. 18 is a bottom front perspective view of the sprayer system shown in FIG. 16.
Figure 19:
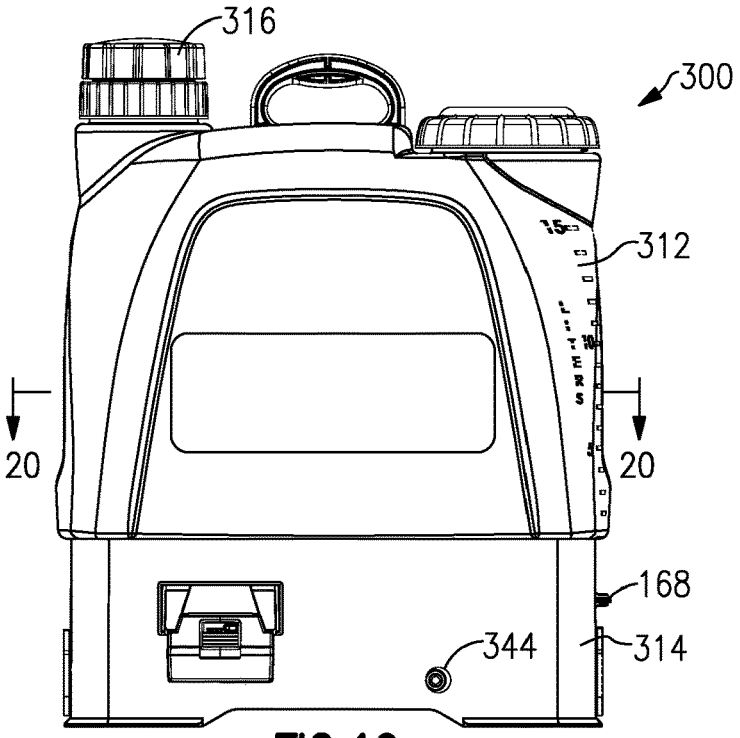
FIG. 19 is a front elevational view of the sprayer system shown in FIG. 16.
Figure 20:
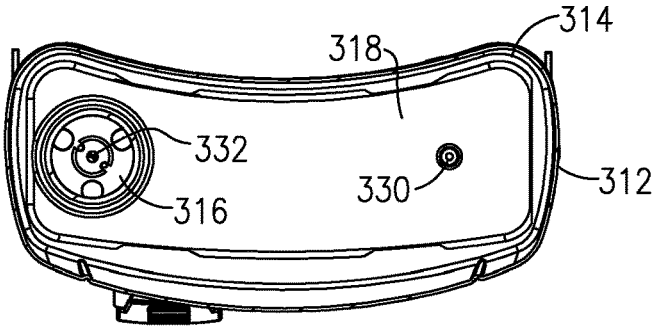
FIG. 20 is a cross section view of the sprayer system, taken generally along line 20-20 in FIG. 19.
Figure 24:
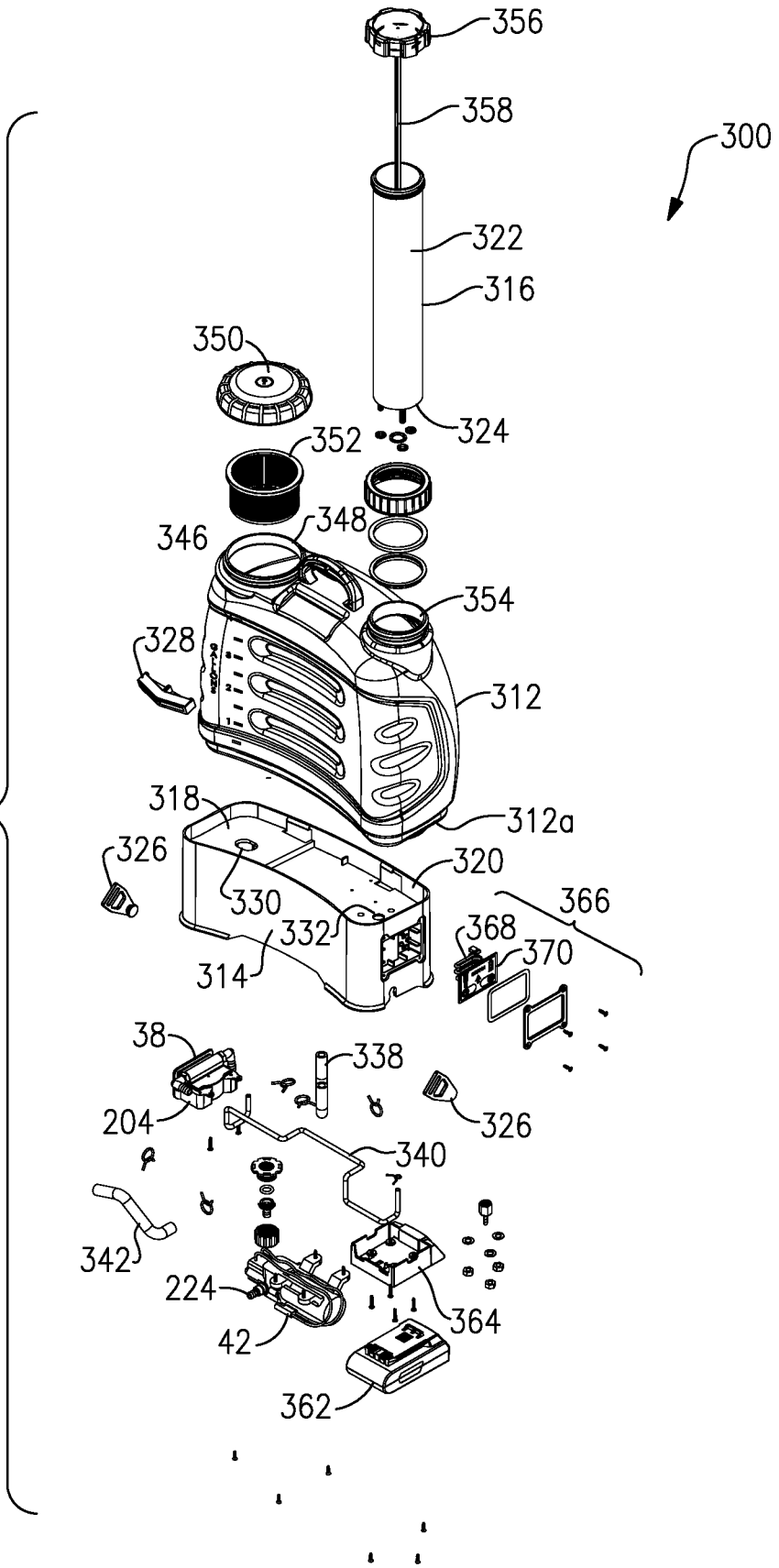
FIG. 24 is an exploded view of the sprayer system shown in FIG. 16.

With continued reference to FIGS. 16-19, 22, 24, and with additional reference to FIG. 20, mounting plate 318 may define a pair of orifices 330, 332 therein. Orifice 330 may be proportioned to allow passage of first tank fitting 334 therethrough, while orifice 332 is proportioned to allow passage of second tank fitting 336 therethrough. A mixing manifold 38 may be mounted to mounting bracket 314 and include a first inlet fitting 48 and second inlet fitting 54. Diluent tubing 338 may fluidly couple first tank fitting 334 with first inlet fitting 48 while concentrate tubing 340 may fluidly couple second tank fitting 336 with second inlet fitting 54. In this manner, mixing manifold 38 may receive a fixed amount of diluent from the first tank and an adjustable amount of liquid concentrate from the second tank. The fixed amount of diluent and adjustable amount of concentrate are then combined within mixing manifold 38 to form a mixed solution which is discharge from mixing manifold 38 through a mixed solution outlet, such as manifold outlet fitting 204 (FIG. 24).

Figure 16:
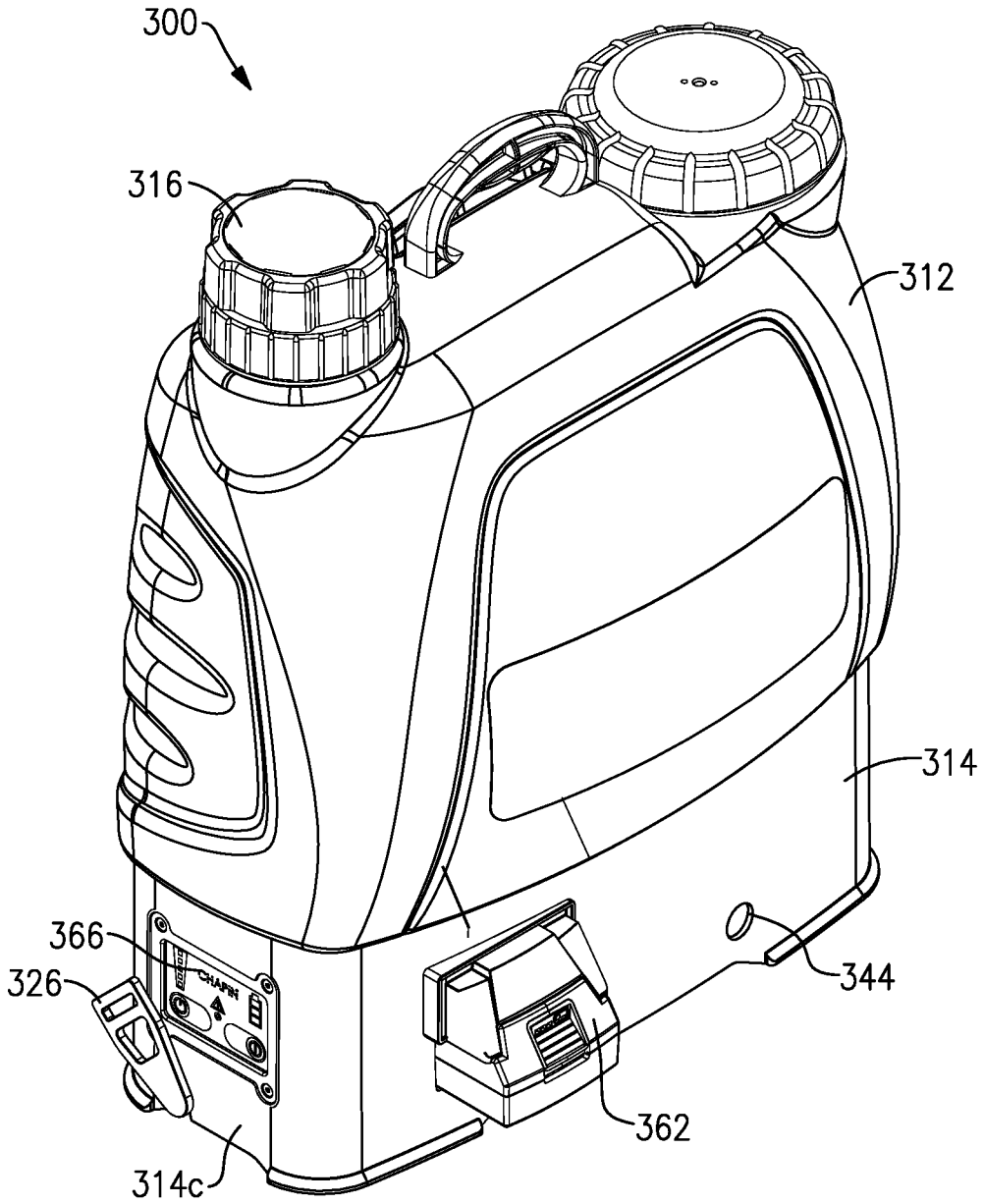
FIG. 16 is a front perspective view of a sprayer system in accordance with an aspect of the present invention.
Figure 21:
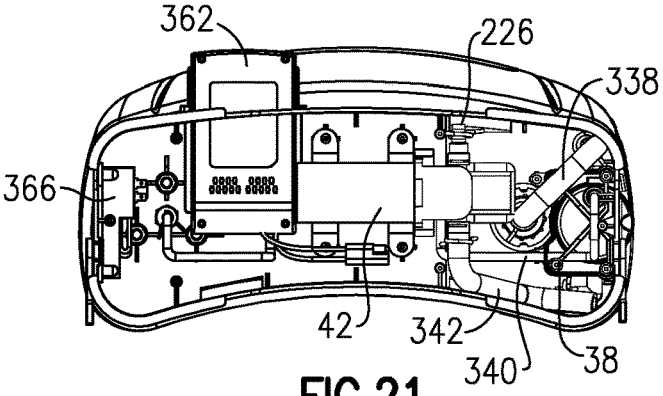
FIG. 21 is a bottom plan view of the sprayer system shown in FIG. 16.

As described above, manifold outlet tubing, such as tubing 342, may fluidly couple manifold outlet fitting 204 with positive displacement pump suction port 224. In this manner, upon a suction stroke of positive displacement pump 42, mixed fluid is drawn into pump 42 from mixing manifold 38. The mixed fluid is comprised of a constant volume of diluent into which is charged a user-selected volume of liquid concentrate. Thus, on a pressure stroke of pump 42, the mixed fluid is forced out of pressure port 226 of positive displacement pump 42 (FIG. 21). Pressure port 226 may be fluidly coupled to a spray device, such as a spray wand (not shown), accessible through hole 344 defined in front wall 314*a* of mounting bracket 314 (FIGS. 16, 18 and 19)

As described above with reference to FIGS. 9-13, housing 58 of mixing manifold 38 may be generally comprised of upper 148 and lower 150 housing subunits. Manifold support member 152 may be interposed between subunits 148, 150. To that end, the interior corners of lower housing subunit 150 may include nodules 154 dimensioned such that respective feet 156 on manifold support member 152 seat upon respective nodules 154. Upper housing subunit 148 may include respective lobes 158 dimensioned to receive a respective foot 156 therein. Each lobe 158 may also include a notch 160 for permitting passage therethrough of a respective leg 162 on manifold support member 152. In this manner, manifold support member 152 may be securely seated within manifold housing 58 and be constrained so as to prevent lateral and torsional movement of manifold support member 152. As described above, manifold support member 152 includes second inlet 54 configured to receive fitment 62. Manifold support member 152 may further include a spring well 164 dimensioned to receive a stop spring 166, as will discussed in greater detail below.

Mixing manifold 38 may further include disc 168 rotatably mounted atop manifold support member 152 whereby center hole 170 defined by disc 168 receives post 172 formed on manifold support member 152. Disc 168 may then be capped by upper housing subunit 148 wherein upper housing subunit 148 includes one or more openings 174 therethrough such that a portion of the outer circumference of disc 168 may be engaged by a user so as to selectively rotate disc 168 about post 172. With additional reference to FIG. 14, disc 168 may further define an outer annular series of spaced-apart through-holes, such as flow metering holes 176*a*-176*h*. Each of flow metering holes 176*a*-176*h* may have a slightly larger diameter than the immediately preceding flow metering hole. In operation one of holes 176*a*-176*h* is aligned with internal bore 178 defined by fitment 62. Fitment spring 63 may urge fitment 62 against disc 168 so as to create and maintain a substantially fluid-tight seal between fitment 62 and disc 168. In this manner, a user may selectively control the volume of liquid concentrate that may pass through disc 168, as will be discussed in greater detail below.

Figure 17:
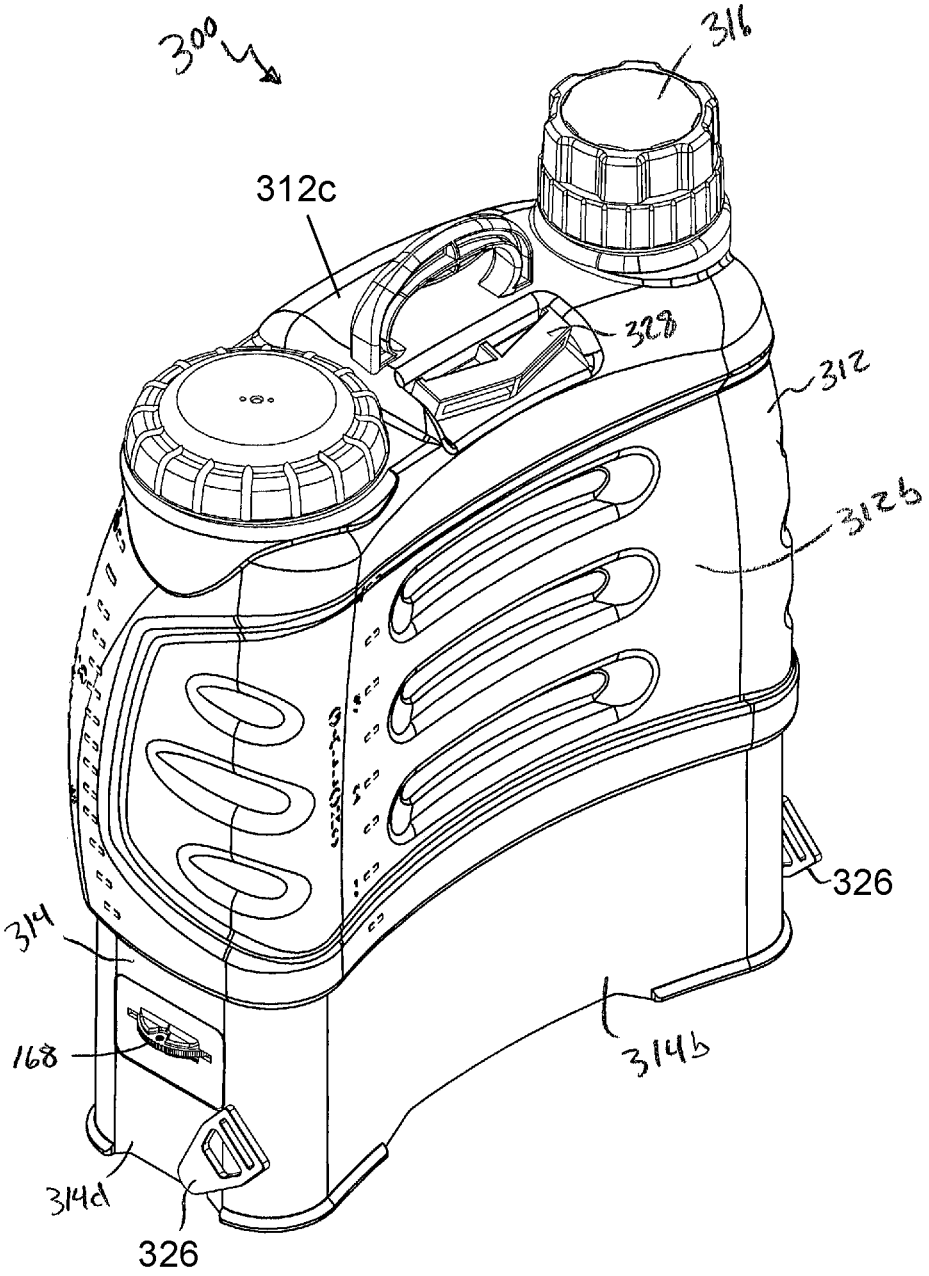
FIG. 17 is a rear perspective view of the sprayer system shown in FIG. 16.

Disc 168 may also further define an inner annular series of spaced apart through-holes, such as chamfered spring stop holes 180*a*-180*h*. Each respective spring stop hole 180*a*-180*h* is configured to align radially with its respective flow metering hole 176*a*-176*h*. In operation, a selected one of holes 180*a*-180*h* is aligned with spring well 164 whereby a positive stop member, such as ball bearing 182, seats within a portion of the selected spring stop hole 180*a*-180*h* through urging of stop spring 166 resident within spring well 164. In this manner, a user may receive feedback indicating proper alignment of the selected flow metering hole 176*a*-176*h* upon seating of ball bearing 182. To change the amount of liquid concentrate added to the diluent stream, a user may rotate disc 168 whereby disc 168 may apply downward force against ball bearing 182 so as to compress stop spring 166 within spring well 164. Disc 168 may then be further rotated until the desired flow metering hole 176*a*-176*h* is aligned with internal bore 178 of fitment 62 such that ball bearing 182 seats within the desired spring stop hole 180*a*-180*h*. As most clearly shown in FIG. 14, disc 168 may also include respective indicia 184*a*-184*h* proximate a respective flow metering hole 176*a*-176*h*. Indicia 184*a*-184*h* may correlate with the respective diameter of respective flow metering holes 176*a*-176*h* so as to provide visual indication to the user as to which of the respective flow metering holes 176*a*-176*h* is currently aligned with internal bore 178 of fitment 62. With reference to FIG. 17, a portion of disc 168 may extend outwardly through sidewall 314*d* such that a user may conveniently adjust the dilution factor of the fluid concentrate comprising the mixed fluid.

As seen most clearly in FIG. 13, mixing manifold 38 may include a fluid channel 186 wherein a first end 188 of fluid channel 186 may define female threads 190 configured to matingly receive corresponding male threads 192 defined by manifold terminus 194 of first inlet fitting 48. The opposing second end 196 of fluid channel 186 may similarly define female threads 198 configured to matingly receive corresponding male threads 200 on manifold terminus 202 of manifold outlet fitting 204. A flow plug 206 may be interposed within fluid channel 186 adjacent the internal extent of female threads 190. Fluid channel 186 may further define a step 208 so as to provide a positive stop to insertion of flow plug 206 in the direction generally indicated by arrow 210. In this manner, bore 212 of first inlet fitting 48 may align with the longitudinal axis P of longitudinal bore 214 of flow plug 206 whereby a constant volume of diluent may be received from first tank 312 after flowing through first inlet fitting 48 into flow plug 206.

As further seen in FIG. 13, flow plug 206 may further include a radially extending bore 216 which may be configured to fluidly align with one of flow metering holes 176*a*-176*h* and internal bore 178 of fitment 62. In this manner, a user selected volume of liquid concentrate may be received from second tank 316, wherein the selected volume of liquid concentrate is then mixed with, and diluted by, the constant volume of diluent being received through first inlet 48 as described above. Flow plug 206 may also define an annular groove 218 configured to define a fluid tight channel with internal wall surface 220 of mixing manifold 38. Annular groove 218 coincides with radially extending bore 216 such that fluid concentrate may still pass through radially extending bore 216 into longitudinal bore 214 should radially extending bore 216 be misaligned with one of flow metering holes 176*a*-176*h* and internal bore 178. Fluid channel 186 may further define a mixing chamber portion 222 which may further promote mixing of the diluent and fluid concentrate prior to outputting the mixed fluid through manifold outlet fitting 204.

Figure 22:
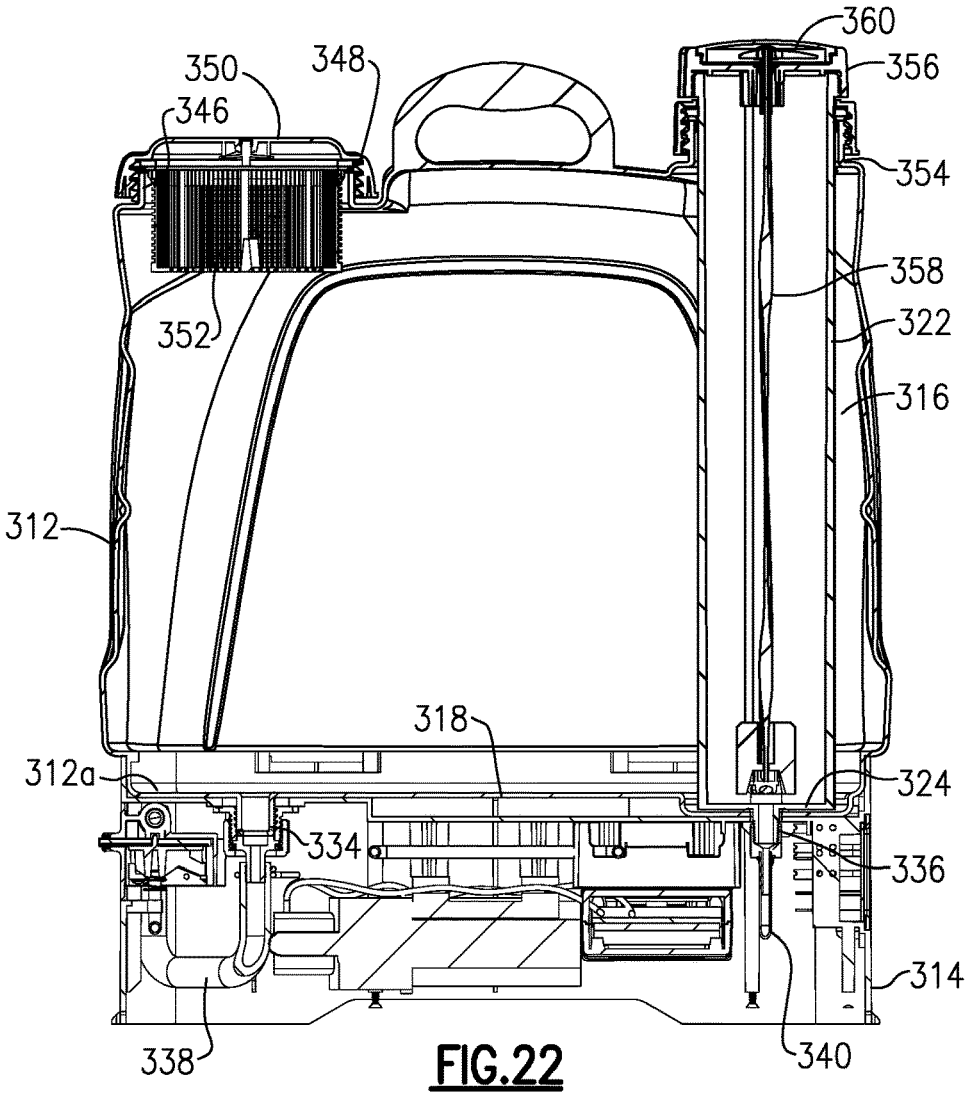
FIG. 22 is a longitudinal cross section view the sprayer system shown in FIG. 19.
Figure 23:
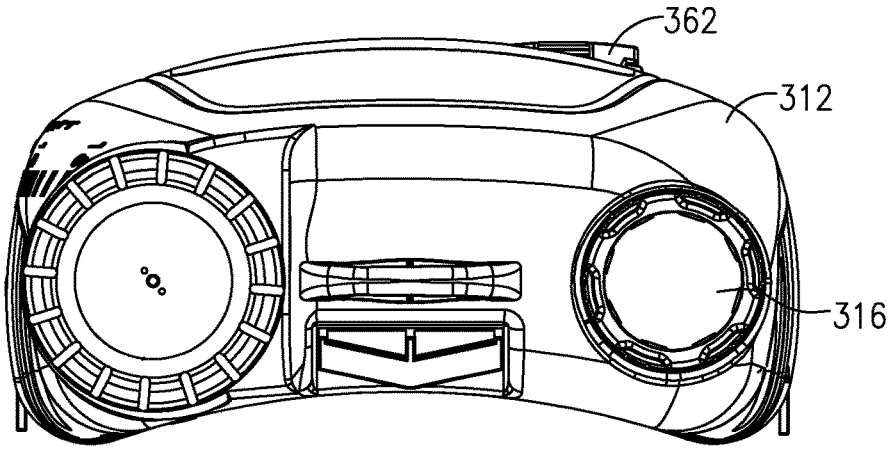
FIG. 23 is top plan view of the sprayer system shown in FIG. 16.

With reference to FIGS. 22 and 24, first tank 312 may be filled with diluent through tank opening 346 defined by a threaded mouth portion 348. A cap 350 may be removably threaded onto mouth portion 348 so as to seal first tank 312. To prevent clogging of downstream plumbing components, mouth portion 348 may further receive filter element 352 therein. When filling first tank 312, the diluent passes through filter element 352 whereby particulate matter larger than the pore size of the filter element will be strained out of the fluid. Accordingly, the pore size of filter element 352 should be selected so as to be smaller than the internal diameter of the smallest diameter downstream component. Similarly, second tank 316 is configured to receive fluid concentrate through mouth portion 354 which is capped by a cap 356. Cap 356 may also carry a fluid level gauge 358, such as but not limited to a float gauge, an ultrasonic level gauge and the like. Cap 356 may also include a dial or meter 360 coupled to gauge 358 so as to provide a visual indication of the fluid volume of the fluid concentrate within second tank 316.

As shown in FIGS. 16, 18 and 24, backpack sprayer system 300 may include a battery 362 configured to provide electrical power to positive displacement pump 42. To that end, front wall 314*a* of mounting bracket 314 may include a battery receiving fixture 364 configured to removably secure battery 362 within mounting bracket 314. In accordance with an aspect of the present invention, battery 362 is a rechargeable, long-life battery, such as a lithium ion battery. Mounting bracket 314 may also include a control unit 366 mounted thereon. Control unit 366 may comprise a printed circuit board (PCB) 368 and control panel interface 370. PCB 368 may include a processor and memory configured to perform one or more functions including power on/power off, regulating power to the positive displacement pump so as to vary output pressure of the mixed solution, monitoring and displaying a battery charge level, and indicating pacing, as described more fully below. Control panel interface 370 includes one or more control buttons whereby a user controls the processor functions of PCB 368.

Figure 25:
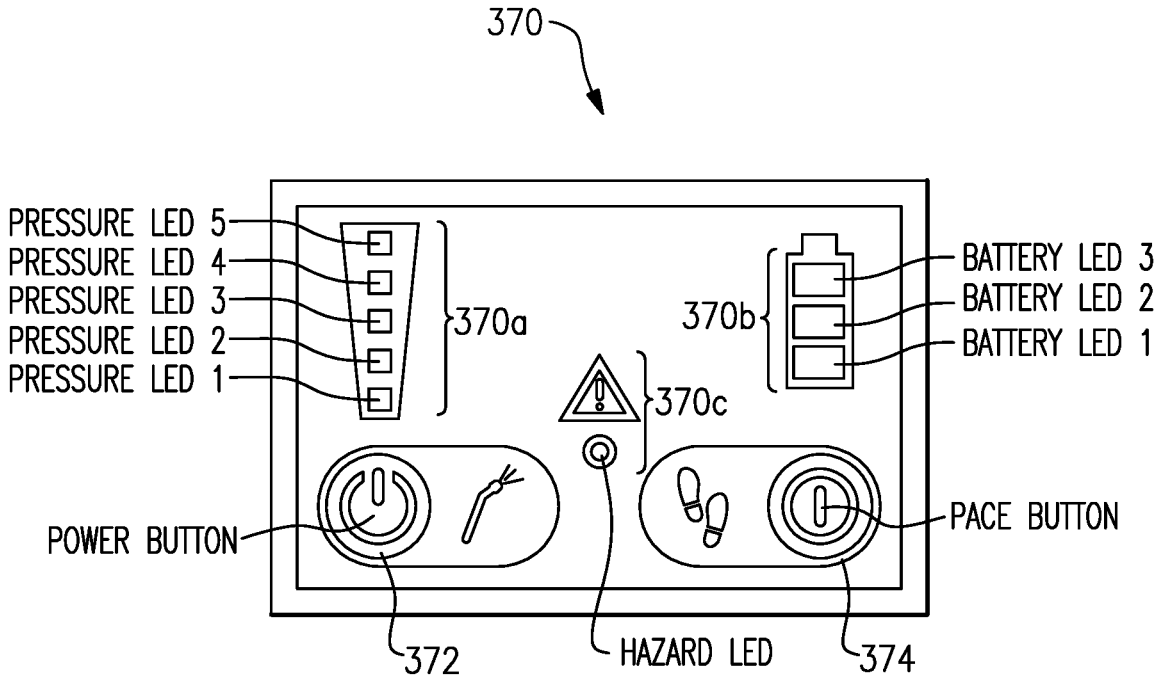
FIG. 25 is a plan view of a control panel interface configured for use with the sprayer system shown in FIG. 16.

As discussed below, control unit 366 may promote smart operation of backpack sprayer system 300. With reference to FIG. 25, control panel interface 370 may generally include a visual display via output pressure LEDS 370*a*, battery charge level LEDS 370*b*, and a warning indicator LED 370*c* and associated buzzer or other audio warning device. Functionality of the display, PCB 368 and mechanical components (i.e., positive displacement pump 42) may be selectively controlled through one or more buttons on control panel interface 370, such as and without limitation, power/control button 372 and pace button 374.

By way of example and without limitation thereto, control unit 366 may enable power on (pressing power/control button 372) and power off (pressing and holding pace button 374 for a predetermined period of time. Pressure status may be generally indicated by output pressure LEDS 370*a*. For instance, the greater the number of LEDS 370*a* lit, the higher the output pressure. Output pressure may be increased by pressing power/control button 372. When at maximum pressure, another press of power/control button 372 will cycle back to the minimum pressure setting. Control unit 366 may also permit setting of a set pressure lock whereby pressing of power/control button 372 will not cycle the output pressure setting. By way of example, to set the pressure lock, PCB 368 may include logic whereby power/control button 372 is held for a predetermined period of time (e.g., 10 seconds) at which point the current pressure setting is locked, even after backpack sprayer system 300 has turned off or battery 362 has been removed and replaced. To disable the pressure lock, PCB 368 may include logic, such as, for example, pressing power/control button 372 three times followed by pressing pace button 374 within 3 seconds.

Similarly, pace button 374 may allow cycling of pacing whereby control unit 366 will emit a beep or other audible signal such that a user may control his or her walking pace so as to apply a more consistent spray. Control unit 366 may also keep track of and indicate total labor time of backpack sprayer system 300. One exemplary control algorithm to display total labor time may include pressing power/control button 372 followed by pressing and holding power/control button 372 and pace button 374 simultaneously for a predetermine period of time. Output pressure LEDS 370*a* may then blink to indicate a time range, i.e., 0 LEDs indicates less than 300 hours, 1 LED indicates between 300 and 700 hours, 2 LEDS indicates between 700 and 1000 hours, etc. Warning indicator LED 370*c* and associated buzzer may be used to indicate a problem associated with the battery, e.g., that the battery has low charge or is experiencing an overvoltage.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A backpack sprayer system comprising:

a) a mounting bracket including a battery receiving fixture configured to removably receive a battery therein;

b) a first tank mounted to the mounting bracket and configured to hold a diluent;

c) a second tank mounted to the mounting bracket and configured to hold a liquid concentrate;

d) a mixing manifold mounted to the mounting bracket, wherein the mixing manifold has a first inlet fitting configured to receive a fixed amount of diluent from the first tank and a second inlet configured to receive a selectively adjustable amount of liquid concentrate from the second tank, whereby the fixed amount of diluent and selectively adjustable amount of concentrate are combined to form a mixed solution, and wherein the mixing manifold includes a mixed solution outlet;

e) a positive displacement pump mounted to the mounting bracket, wherein the positive displacement pump includes a suction port fluidly coupled to the mixed solution outlet and a pressure port configured to fluidly couple with a spray device; and f) a control unit mounted on the mounting bracket, wherein the control unit is configured to receive power from the battery.

2. The sprayer system of claim 1 wherein the positive displacement pump is a diaphragm pump.

3. The sprayer system of claim 1 wherein the mixing manifold further includes a disc defining a first annular series of spaced-apart flow-metering holes, wherein successive respective flow-metering holes have an increasing hole diameter, wherein the disc is adapted to rotate to align a selected flow-metering hole of the annular series of spaced-apart holes in fluid communication with the second inlet to thereby define the selectively adjustable amount of concentrate in the mixed solution.

4. The sprayer system of claim 3 wherein the disc further defines a second annular series of spaced-apart stop holes, wherein each respective stop hole within the second annular series radially aligns with a respective flow-metering hole of the first annular series, wherein a single respective stop hole receives a stop member when the selected flow-metering hole is aligned with the second inlet.

5. The sprayer system of claim 4 wherein the stop member is a ball bearing biased to engage the disc, wherein a diameter of the ball bearing is slightly larger than a diameter of each of the stop holes.

6. The sprayer system of claim 1 wherein the first inlet fitting further includes a check valve configured to prevent backflow of the mixed solution toward the first tank.

7. The sprayer system of claim 1 further comprising:

g) a battery removably secured within the battery receiving fixture, wherein the battery is operably coupled to the positive displacement pump and control unit whereby the battery is configured to provide power to the positive displacement pump and control unit when the sprayer system is in an on configuration.

8. The sprayer system of claim 1 wherein the second tank is fixedly secured within the first tank, whereby an open volume defined by the second tank is fluidly isolated from an open volume defined by the first tank.

9. The sprayer system of claim 8 wherein the second tank includes a concentrate fitting configured to receive a first end of a concentrate tube, whereby a second end of the concentrate tube is coupled to the second inlet of the mixing manifold, and wherein the first tank includes a diluent fitting configured to receive a first end of a diluent tube, whereby a second end of the diluent tube is coupled to the first inlet fitting of the mixing manifold.

10. The sprayer system of claim 1 wherein the second tank includes a liquid level gauge.

11. The sprayer system of claim 1 wherein the control unit comprises:

a) a printed circuit board including a processor and a memory, wherein the processor is configured to perform one or more functions including power on/power off, regulating power to the positive displacement pump so as to vary output pressure of the mixed solution, monitoring and displaying a battery charge level, and indicating pacing;

b) a control panel interface coupled to the printed circuit board, wherein the control panel interface includes one or more control buttons whereby a user controls the processor functions.

* * * * *